US011814207B2

(12) United States Patent
Vilag et al.

(10) Patent No.: US 11,814,207 B2
(45) Date of Patent: Nov. 14, 2023

(54) AUTOMATED PACKAGING STATION AND SYSTEM FOR PACKAGING OBJECTS

(71) Applicant: Sealed Air Corporation (US), Charlotte, NC (US)

(72) Inventors: Brian Vilag, Fort Mill, SC (US); Bradley Powell, Rock Hill, SC (US); Morgan R. Stewart, Belmont, NC (US); Todd Rodgers, Gastonia, NC (US); Joshua Woodie, Troutman, NC (US); Garrett P. Dyer, Charlotte, NC (US); James Bravado, Huntersville, NC (US); Yunji Gu, Gastonia, NC (US); Michael Andrew Clarke, Gastonia, NC (US); Jonathan D. Skolrood, Cornelius, NC (US); Preston Chad Stephens, Charlotte, NC (US)

(73) Assignee: Sealed Air Corporation (US), Charlotte, NC (US)

( * ) Notice: Subject to any disclaimer, the term of this patent is extended or adjusted under 35 U.S.C. 154(b) by 130 days.

(21) Appl. No.: 17/414,563

(22) PCT Filed: Dec. 18, 2019

(86) PCT No.: PCT/US2019/067037

§ 371 (c)(1),
(2) Date: Jun. 16, 2021

(87) PCT Pub. No.: WO2020/131988

PCT Pub. Date: Jun. 25, 2020

(65) Prior Publication Data

US 2022/0041312 A1 Feb. 10, 2022

Related U.S. Application Data

(60) Provisional application No. 62/783,250, filed on Dec. 21, 2018.

(51) Int. Cl.
*B65B 9/08* (2012.01)
*B65B 35/12* (2006.01)
(Continued)

(52) U.S. Cl.
CPC ..... *B65B 9/08* (2013.01); *B65B 5/022* (2013.01); *B65B 9/093* (2013.01); *B65B 35/12* (2013.01);
(Continued)

(58) Field of Classification Search
CPC B65B 5/022; B65B 9/08; B65B 9/093; B65B 35/12; B65B 43/267; B65B 55/20;
(Continued)

(56) References Cited

U.S. PATENT DOCUMENTS 2,899,784 A * 8/1959 Cleveland et al. ..... B65B 57/20 53/500
3,142,599 A 7/1964 Chavannes
(Continued)

FOREIGN PATENT DOCUMENTS

CA 2651028 A1 * 11/2007 ..... B65B 35/12
DE 2010359 A1 9/1971
(Continued)

*Primary Examiner* — Stephen F. Gerrity
(74) *Attorney, Agent, or Firm* — Jon M. Isaacson

(57) ABSTRACT

An automated packaging station is capable of being used to package objects. The automated packaging station includes a supply of web material, a surface (202), an aperture (206) therein, and a closing system. The automated packaging station is configured to form the web material into a pouch. The aperture (206) is configured such that an object can be inserted therethrough. The automated packaging station is configured to bias open the pouch beneath the surface such that the object inserted through the aperture falls into the pouch. The closing system is configured to close the pouch to form a package around the object in response to the object
(Continued)

being inserted through the aperture. The object is capable of being shipped to a recipient in the package.

11 Claims, 7 Drawing Sheets

(51) Int. Cl.

| | |
|---|---|
| ***B65B 43/26*** | (2006.01) |
| ***B65B 55/20*** | (2006.01) |
| ***B65B 61/02*** | (2006.01) |
| ***B65B 67/04*** | (2006.01) |
| ***B65B 65/00*** | (2006.01) |
| ***B65B 5/02*** | (2006.01) |
| ***B65B 9/093*** | (2012.01) |

(52) U.S. Cl.
CPC ..... *B65B 43/267* (2013.01); *B65B 55/20* (2013.01); *B65B 61/02* (2013.01); *B65B 65/006* (2013.01); *B65B 67/04* (2013.01)

(58) Field of Classification Search
CPC ..... B65B 61/02; B65B 61/202; B65B 61/28; B65B 65/006; B65B 67/00; B65B 67/04; B65B 57/10; B65B 57/12; B31D 5/0073; A47F 2009/044
USPC ..... 53/455, 562, 202, 498, 500, 546, 284.3; 186/66
See application file for complete search history.

(56) References Cited

U.S. PATENT DOCUMENTS

| | | | | | |
|---|---|---|---|---|---|
| 3,208,898 | A | | 9/1965 | Chavannes et al. | |
| 3,285,793 | A | | 11/1966 | Chavannes | |
| 3,508,992 | A | | 4/1970 | Chavannes | |
| 3,586,565 | A | | 6/1971 | Fielding | |
| 3,616,155 | A | | 10/1971 | Chavannes | |
| 3,628,302 | A | * | 12/1971 | Roberts | B65B 57/14 53/502 |
| 3,660,189 | A | | 5/1972 | Troy | |
| 3,673,765 | A | | 7/1972 | Dohmeier et al. | |
| 3,859,062 | A | | 1/1975 | Okubo et al. | |
| 3,930,350 | A | * | 1/1976 | Reid | B65B 9/06 53/511 |
| 4,094,125 | A | | 6/1978 | Gess | |
| 4,181,548 | A | | 1/1980 | Weingarten | |
| 4,184,904 | A | | 1/1980 | Gaffney | |
| 4,415,398 | A | | 11/1983 | Ottaviano | |
| 4,448,010 | A | * | 5/1984 | Stohlquist et al. | B65B 1/02 53/562 |
| 4,576,669 | A | | 3/1986 | Caputo | |
| 4,579,516 | A | | 4/1986 | Caputo | |
| 4,676,343 | A | * | 6/1987 | Humble et al. | A47F 9/047 902/22 |
| 4,729,210 | A | * | 3/1988 | Galliano | B65B 57/12 53/551 |
| 4,909,356 | A | * | 3/1990 | Rimondi et al. | B65B 9/213 53/562 |
| 5,167,301 | A | | 12/1992 | Cappi et al. | |
| 5,191,749 | A | * | 3/1993 | Cappi et al. | A47F 9/042 186/59 |
| 5,551,531 | A | * | 9/1996 | Dumont | A47F 9/042 186/61 |
| 6,800,162 | B2 | | 10/2004 | Kannankeril et al. | |
| 6,982,113 | B2 | | 1/2006 | Kannankeril et al. | |
| 7,018,495 | B2 | | 3/2006 | Kannankeril et al. | |
| 7,165,375 | B2 | | 1/2007 | O'Dowd | |
| 7,220,476 | B2 | | 5/2007 | Sperry et al. | |
| 7,223,461 | B2 | | 5/2007 | Kannankeril et al. | |
| 7,429,304 | B2 | | 9/2008 | McNamara et al. | |
| 7,721,781 | B2 | | 5/2010 | Sperry et al. | |
| 7,950,433 | B2 | | 5/2011 | Sperry et al. | |
| 10,967,995 | B1 | * | 4/2021 | Hoffman et al. | B65B 9/08 |
| 2005/0055987 | A1 | * | 3/2005 | White, Jr. et al. | B31D 5/0073 53/520 |
| 2009/0158695 | A1 | * | 6/2009 | Jostler et al. | B65B 43/267 53/469 |
| 2010/0282824 | A1 | | 11/2010 | Kannankeril et al. | |
| 2014/0130461 | A1 | | 5/2014 | Johan | |
| 2014/0260094 | A1 | | 9/2014 | Wehrmann | |
| 2014/0314978 | A1 | | 10/2014 | Lepine et al. | |
| 2015/0075114 | A1 | | 3/2015 | Murch et al. | |
| 2017/0225813 | A1 | * | 8/2017 | Wehrmann | B65B 55/20 |

FOREIGN PATENT DOCUMENTS

| | | | | |
|---|---|---|---|---|
| GB | 2330819 | A1 | | 5/1999 |
| JP | 52052792 | A | * | 4/1977 |

* cited by examiner

AUTOMATED PACKAGING STATION AND SYSTEM FOR PACKAGING OBJECTS

BACKGROUND

The present disclosure is in the technical field of packaging stations packaging objects for shipping. More particularly, the present disclosure is directed to automated packaging stations that are capable of effectively packaging objects with minimal amounts of human labor in the packaging process.

Consumers frequently purchase goods from mail-order or internet retailers, which package and ship the goods to the purchasing consumer via a postal service or other carrier. Millions of such packages are shipped each day. These items are normally packaged in small containers, such as boxes or envelopes. To protect the items during shipment, they are typically packaged with some form of protective dunnage that may be wrapped around the item or stuffed into the container to prevent movement of the item and to protect it from shock.

Common types of mailing envelope are sometimes referred to as "mailers." In some cases, these mailers have cushioning to provide some level of protection for the objects transported therein. The outer walls of cushioned mailers are typically formed from protective materials, such as Kraft paper, cardstock, polyethylene-coated paper, other paper-based materials, polyethylene film, or other resilient materials. The inner walls of cushioned mailers are lined with cushioning materials, such as air cellular material (e.g., BUBBLE WRAP™ air cellular material sold by Sealed Air Corporation), foam sheets, or any other cushioning material. The outer walls are typically adhered (e.g., laminated) to the cushioning material when forming the mailers.

When goods are shipped in rigid containers, such as corrugated cardboard boxes, dunnage material is typically added to the containers to take up some of the void space within the containers. Inflated cushions, pillows, or other inflated containers are common void fill materials that are either placed loose in a container with an object or wrapped around an object that is then placed in a container. The cushions protect the packaged item by absorbing impacts that may otherwise be fully transmitted to the packaged item during transit, and also restrict movement of the packaged item within the carton to further reduce the likelihood of damage to the item. Another common form of void fill material is paper, such as Kraft paper, that has been folded or crumped into a low-density, three-dimensional pad or wad that is capable of filling void space without adding significant weight to the container.

It would be advantageous to automate the packaging process to minimize the amount of time required to package objects properly. However, given the wide variety of ways which objects can be packaged for shipping, automation of the packaging process can be challenging.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, an automated packaging station includes a supply of web material, a surface, an aperture, and a closing system. The automated packaging station is configured to form the web material into a pouch. The aperture is configured such that an object can be inserted therethrough. The automated packaging station is configured to bias open the pouch beneath the surface such that the object inserted through the aperture falls into the pouch. The closing system is configured to close the pouch to form a package around the object in response to the object being inserted through the aperture. The object is capable of being shipped to a recipient in the package.

In a second embodiment, the supply of the web material of the first embodiment is located below the surface.

In a third embodiment the web material of the second embodiment has a series of chambers. The automated packaging station further includes an inflation and sealing system configured to inflate the chambers and to individually seal the chambers as part of forming the web material into the pouch.

In a fourth embodiment, the automated packaging station of the third embodiment further includes a seal and cutting system configured to form a trailing transverse seal, a leading transverse seal, and transverse line of weakness in the web material after inflation of the chambers. The seal and cutting system is located below the surface.

In a fifth embodiment, the automated packaging station of the fourth embodiment further comprising a movable structure located under the surface and a housing located under the surface. The supply, the inflation and sealing system, and the seal and cutting system are positioned on the movable structure. The supply, the inflation and sealing system, and the seal and cutting system are located within the housing. The supply, the inflation and sealing system, and the seal and cutting system are capable of being moved out of the housing by moving the movable structure.

In a sixth embodiment, the automated packaging station of any of the previous embodiments further comprises a pouch biasing system configured to bias open the pouch. The pouch biasing system is configured to bias open the pouch beneath the surface such that the object inserted through the aperture falls into the pouch.

In a seventh embodiment, the pouch biasing system of the sixth embodiment includes biasing brackets configured to be moved from a closed position to an open position. When the biasing brackets are in the open position, the biasing brackets bias edges of an opening of the pouch away from each other.

In an eighth embodiment, in the automated packaging station of the seventh embodiment, the biasing brackets are biased toward the closed position and, when the biasing brackets are in the closed position, the biasing brackets substantially cover the aperture.

In a ninth embodiment, the automated packaging station of the seventh the sixth embodiment further comprises a computing device communicatively coupled to the pouch biasing system. The computing device is configured to control the pouch biasing system to: cause the biasing brackets to move to the open position in response to the automated packaging station being ready to have the object inserted through the aperture and cause the biasing brackets to move to the closed position in response to the object being inserted through the aperture.

In a tenth embodiment, the automated packaging station of any of the previous embodiments further comprises a labelling system configured to apply a label to the package. The label includes shipping information for shipping the package.

In an eleventh embodiment, the automated packaging station of the tenth embodiment further comprises a scanning device configured to scan or determine an identifier associated with the object before the object before the object is inserted through the aperture.

In a twelfth embodiment, the automated packaging station of the eleventh embodiment further comprises a computing device communicatively coupled to each of the scanning device and the labeling system. The computing device is configured to receive the identifier from the scanning device, determine the shipping information based on the identifier, and provide the shipping information to the labeling system before the labeling system applied the label to the package.

In a thirteenth embodiment, applying the label to the package in any of the tenth through the twelfth embodiments includes at least one of: printing the shipping information on an adhesive label and adhering the adhesive label to the package, or printing the shipping information directly on the package.

In a furtherment embodiment, the automated packaging station of any of the previous embodiments is configured to bias open the pouch beneath the surface such that an object inserted through the aperture by falling substantially vertically into the pouch.

In a fifteenth embodiment, the automated packaging station of any of the previous embodiments further comprises a conveying mechanism configured to carry the package out from the automated packaging station in response to the closing system closing the pouch to form the package.

In a sixteenth embodiment, a portion of the surface of any of the previous embodiments includes a view panel that is transparent or semi-transparent and the aperture is located in the view panel.

In a seventeenth embodiment, a system for packaging objects comprises a common conveying mechanism and a plurality of automated packaging stations. Each of the plurality of automated packaging stations includes a surface and an aperture. Each of the plurality of automated packaging stations is configured to: form a web material into a pouch, bias open the pouch beneath the surface such that an object inserted through the aperture falls into the pouch, and close the pouch to form a package around the object in response to the object being inserted through the aperture. Packages formed by respective ones of the plurality of automated packaging stations are configured to be conveyed from the respective ones of the plurality of automated packaging stations to the common conveying mechanism.

In an eighteenth embodiment, the system of any of the seventeenth and eighteenth embodiments is located in a packaging facility and the common conveying mechanism is configured to convey the packages formed by the plurality of automated packaging stations to a location within the packaging facility where the packages will be further processed for shipping.

In a nineteenth embodiment, the system of the seventeenth embodiment further comprises a computing system communicatively coupled to each of the plurality of automated packaging stations. Each of the plurality of automated packaging stations includes a scanning device capable of scanning or determining an identifier associated with an object to be packaged. The computing system is configured to receive identifiers associated with objects from the plurality of automated packaging stations and to provide shipping information to the plurality of automated packaging stations based on the identifiers received from the plurality of automated packaging stations.

In a twentieth embodiment, each of the plurality of automated packaging stations in the nineteenth embodiment is configured to apply labels to packages based on the shipping information received from the computing system.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of automated packaging stations that reduce the amount of human labor required to package objects, reduce the level of skill and/or training required for packers, and increase the throughput of packaging stations. In some embodiments, an automated packaging station is configured to form a pouch and to hold the pouch open below an aperture in the surface. A packer is able to scan the object using a scanning device of the automated packaging station to enable the automated packaging station to obtain shipping information for the object. The packer inserts the object through the aperture so that it falls into the open pouch. The automated packaging station can close the pouch to form a package around the object, label the package for shipping, and carry the package outside of the automated packaging station. Additional elements and variations of automated packaging stations are described in greater detail below.

Figure 1:
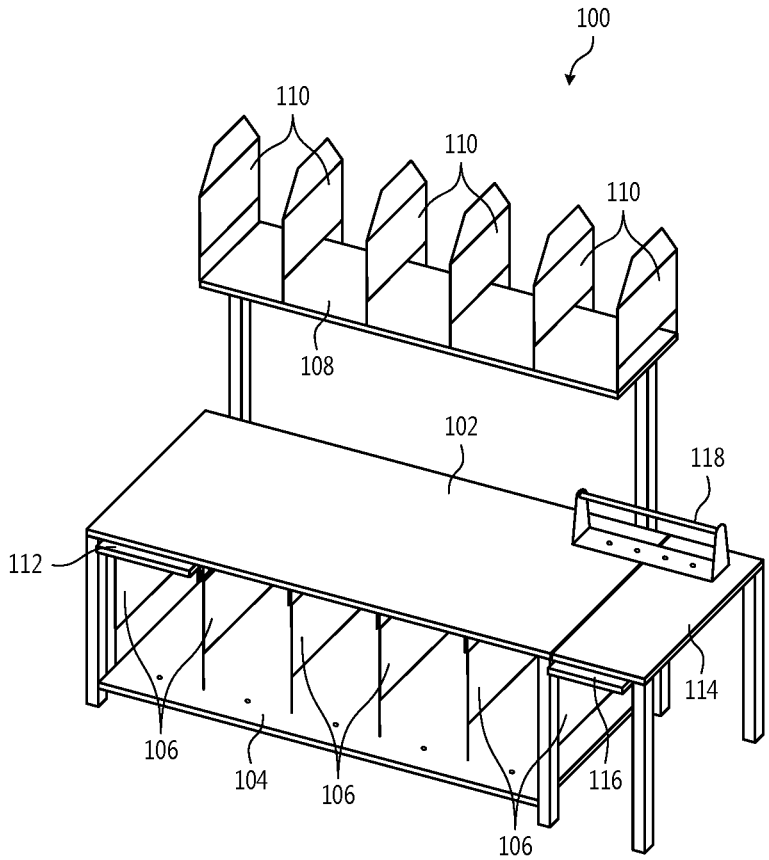
FIG. 1 depicts an embodiment of a packaging station that has traditionally been used to form packages for shipping.

Depicted in FIG. 1 is an embodiment of a packaging station 100 that has traditionally been used to form packages for shipping. The packaging station 100 includes a working surface 102 where a packer can place items, such as packaging materials, objects to be packaged, packing tools (e.g., tape dispensers), and the like.

The packaging station 100 also includes a lower shelf 104 that is located below the working surface 102. In the depicted embodiment, the lower shelf 104 is supported by the same legs that support the working surface 102. The packaging station 100 also includes dividers 106 that divide the lower shelf 104 into areas where packaging materials can be stacked. For example, unfolded cardboard boxes in a "lay-flat" configuration can be stacked between the dividers 106, with different sizes of boxes in each of the divided spaces between the dividers 106.

The packaging station 100 also includes an upper shelf 108 that is located above the working surface 102. In the depicted embodiment, the upper shelf 108 is supported by legs that extend up from the back of the working surface 102. The packaging station 100 also includes dividers 110 that divide the upper shelf 108 into areas where packaging materials can be stacked. For example, unused mailers can be stacked between the dividers 110, with different sizes of mailers in each of the divided spaces between the dividers 110.

One benefit of the packaging station 100 is that it is modular, allowing for different setups of packaging materials to be stored in the packaging station 100 depending on the packing needs at the packaging station 100. In one example, a pull-out shelf 112 has been added below the working surface 102. This pull-out shelf 112 can be pulled out to provide additional working space beyond the area available on the working surface 102. In another example, an extension surface 114 has been added to the side of the working surface 102 to provide additional working area. The extension surface also has a pull-out shelf 116 that can be pulled out to provide additional working space beyond the area available on the working surface 102 and the extension surface 114. In another example, a spindle 118 has been attached to the working surface 102 and the extension surface 114. The spindle 118 can hold rolls of packaging material, such as a roll of air cellular material or a roll of packing paper, to make that packaging material readily available to the packer.

In some examples, the cushion material is an inflated air cellular material. As used herein, the term "air cellular material" herein refers to bubble cushioning material, such as BUBBLE WRAP® air cushioning material sold by Sealed Air Corporation, where a first film or laminate is formed (e.g., thermoformed, embossed, calendared, or otherwise processed) to define a plurality of cavities and a second film or laminate is adhered to the first film or laminate in order to close the cavities. Examples of air cellular materials are shown in U.S. Pat. Nos. 3,142,599, 3,208,898, 3,285,793, 3,508,992, 3,586,565, 3,616,155, 3,660,189, 4,181,548, 4,184,904, 4,415,398, 4,576,669, 4,579,516, 6,800,162, 6,982,113, 7,018,495, 7,165,375, 7,220,476, 7,223,461, 7,429,304, 7,721,781, and 7,950,433, and U.S. Published Patent Application Nos. 2014/0314978 and 2015/0075114, the disclosures of which are hereby incorporated by reference in their entirety.

As used herein, an "object" may comprise a single item for packaging or grouping of several distinct items where the grouping is to be in a single package. Further, an object may include an accompanying informational item, such as a packing slip, tracking code, a manifest, an invoice, or printed sheet comprising machine-readable information (e.g., a bar code) for sensing by an object reader (e.g., a bar code scanner). In some embodiments, each of the objects includes an object identifier. In some examples, the object identifier includes one or more of a barcode, a quick response (QR) code, a radio frequency identification (RFID) tag, any other form a machine-readable information, human-readable information, or any combination thereof.

While the packaging station 100 is modular and provides a wide range of packaging options for the packer, there are a number of drawbacks to the packaging station 100. With so many packaging materials available for use at the packaging station 100, the packaging station 100 often becomes disorganized. For example, tools (e.g., tape dispensers, box cutters, etc.) left on the working surface 102, scraps of packaging material (e.g., pieces of air cellular material, pieces of packaging material, etc.) on or around the packaging station 100, pieces of adhesive consumables (e.g., pieces of tape, labels not used on a shipping container, etc.) may be stuck to the packaging station 100, waste from the packaging process (e.g., release liners pull off of pressure-sensitive adhesives), and the like. In addition, the many packaging options require a high level of training and skill for the packer to operate. For example, when packaging a particular object, the packer must choose what types of packaging material to use, such as whether to use a mailer or a box, whether to use cushioning or void fill material, and the like. If the packer does not have a high level of training and skill, which can often be the case in large packaging facilities, the packer may not choose optimal packaging material for packaging the object to provide proper protection for the object, reducing the cost of shipping the object, and the like.

Using the packaging station 100, a typical experienced packer can form about 1-3 packages per minute. However, as noted above, many packers are not experienced and cannot form packages at such rates. In addition, when forming packages at high rates, packers may not make optimal decisions about how to package objects in order to optimize protection of the object, minimize shipping cost, and reduce the amount of packaging material used. It would be desirable to automate the packaging of objects to increase packaging rates, reduce the skill and training required for packers, and minimize shipping costs for objects.

Figure 2:
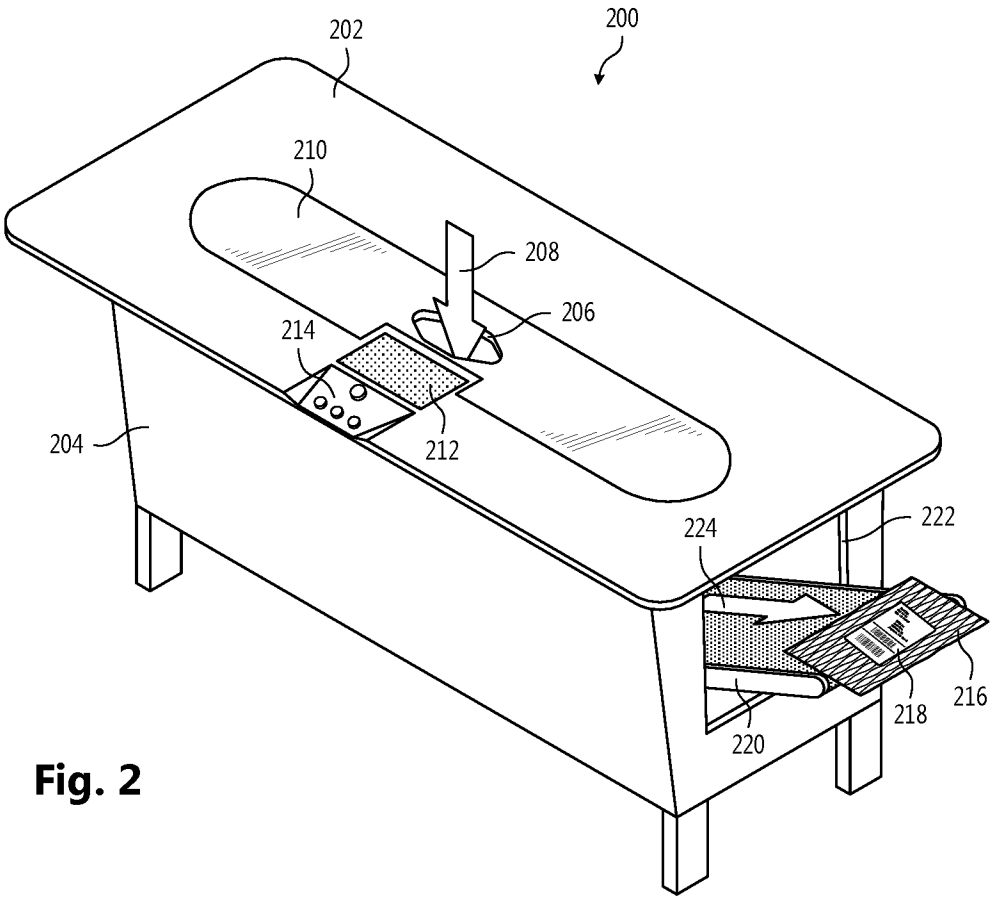
FIG. 2 depicts a perspective view of an embodiment of an automated packaging station, in accordance with the embodiments described herein.

Depicted in FIG. 2 is a perspective view of an embodiment of an automated packaging station 200. As used herein, the term "automated" means at least semi-automated. For example, the term "automated packaging station" refers to a packaging station for packaging objects that provides at least semi-automated packaging. Thus, an "automated packaging station" can require at least some manual labor to package objects but can also be entirely automated so that no manual labor is required to package objects.

The automated packaging station 200 includes a surface 202. In the depicted embodiment, the surface 202 is the top of the automated packaging station 200. In some embodiments, the automated packaging station 200 may resemble a table such that the surface 202 resembles a tabletop. The surface 202 is supported by a housing 204. In some embodiments, the housing 204 encompasses elements of the automated packaging station 200 that provide at least semi-automation of the packaging process. Examples of such elements are discussed below, particularly with respect to FIGS. 3A and 3B.

The surface 202 includes an aperture 206. The aperture 206 is arranged so that objects can be inserted (e.g., dropped) into the housing 204 through the aperture 206 in the surface 202. In the depicted embodiment, the aperture 206 is located so that an object can be inserted in a direction 208 that is substantially vertical. For example, a packer can drop the object through the aperture 206 so that the force of gravity acts on the object, causing the object to fall through the aperture 206 and into the space encompassed by the housing 204. In the depicted embodiment, the surface 202 includes a view panel 210 and the aperture 206 is located in the view panel 210. In some embodiments, the view panel 210 is transparent or semi-transparent and the housing 204 and the portions of the surface 202 outside of the view panel 210 are opaque. This may allow a packer to view inside the space encompassed by the housing 204 to determine whether the automated packaging station 200 is operating properly. In some embodiments, the view panel 210 is replaceable in that it can be removed from the automated packaging station 200 and replaced by another view panel. In some embodiments, different view panels have apertures of different sizes to allow the aperture size to be varied for the automated packaging station 200 by replacing the view panel.

As used herein, the terms "opaque" and "transparent" may be defined in terms of one or more of total luminous transmittance, opacity, or contrast ratio opacity. Total luminous transmittance may be defined as the percentage of luminous flux that passes through a material when visible light is transmitted at the material. In some embodiments, a material is opaque if the material has a total luminous transmittance that is at or below any one of the following values: 10%, 20%, 30%, 40%, 50%, 60%, 65%, 70%, 75%, 80%, 85%, and 90%, measured in accordance with ASTM D1003. Similarly, in some embodiments, a material is transparent if the material has a total luminous transmittance that is at or above any one of the following values: 90%, 80%, 70%, 60%, 50%, 40%, 35%, 30%, 25%, 20%, 15%, and 10%, measured in accordance with ASTM D1003.

Opacity may be defined as the percentage of luminous flux that does not pass through a material when visible light is transmitted at the material. Opacity may be defined according to the formula 100%–total transmittance=opacity. In some embodiments, a material is opaque if the material has a total luminous transmittance that is at or above any one of the following values: 10%, 20%, 30%, 40%, 50%, 60%, 65%, 70%, 75%, 80%, 85%, and 90%. Similarly, in some embodiments, a material is transparent if the material has a total luminous transmittance that is at or below any one of the following values: 90%, 80%, 70%, 60%, 50%, 40%, 35%, 30%, 25%, 20%, 15%, and 10%.

Contrast ratio opacity measurement characterizes how opaque a material sample is using two readings: a Y (luminance or brightness) value measured with the material sample backed by a black background and a Y value measured with the material sample backed by a white background. The resulting fraction is expressed as Y %, calculated as follows:

$$\text{Opacity}(Y) = \frac{Y_{black\ backing}}{Y_{white\ backing}} \times 100$$

In some embodiments, a material is opaque if the contrast ratio opacity for the material is at least, and/or at most, any one of the following values: 10%, 20%, 30%, 40%, 50%, 60%, 65%, 70%, 75%, 80%, 85%, and 90%, calculated per above with base values measured in accordance with ASTM D1746. Similarly, in some embodiments, a material is transparent if the contrast ratio opacity for the material is at most, and/or at least, any one of the following values: 90%, 80%, 70%, 60%, 50%, 40%, 35%, 30%, 25%, 20%, 15%, and 10%, calculated per above with base values measured in accordance with ASTM D1746.

In the depicted embodiment, the automated packaging station 200 includes a scanning device 212 configured to scan an identifier associated with an object. In some embodiments, the identifier associated with the object includes a unique identifier of the object, such as a unique serial number. In some embodiments, the identifier associated with the object includes an identifier of the type of the object, such as a SKU (stock keeping unit) number, a UPC (universal product code), a manufacturer and/or model name, and the like. In some embodiments, the identifier associated with the object includes an identifier of an order which includes the object. In some embodiments, the identifier associated with the object includes any of the examples of identifiers described above, any other identifier associated with the object, or any combination thereof.

In some embodiments, the scanning device 212 is configured to read and/or determine the identifier of the object. In some embodiments, the scanning device 212 includes a barcode scanner configured to read a barcode that includes the identifier. In some embodiments, the scanning device 212 includes a camera configured to read a QR code that includes the identifier. In some embodiments, the scanning device 212 includes a camera configured to capture an image of the object so that a computing device (e.g., a computing device that includes image classification software) can determine the identifier of the object based on the image. In some embodiments, the scanning device 212 includes a radio frequency identification (RFID) scanner configured to read an RFID tag that includes the identifier. In some embodiments, the scanning device 212 includes any of the examples of scanning devices described above, any other type of system that can read and/or determine the identifier of the object, or any combination thereof.

In some embodiments, when a packer will package an object using the automated packaging station 200, the packer will first scan the object using the scanning device 212. As will be described in greater detail below, the automated packaging station 200 can include a computing device, such as a controller, that controls portions of the packaging process based on the identifier read by the scanning device 212. After the packer scans the object using the scanning device 212, the packer can insert (e.g., drop) the object through the aperture 206 into the space encompassed by the housing 204 to be packaged. In the depicted embodiment, the scanning device 212 is integrated into the surface 202 of the automated packaging station 200. It will be apparent that the scanning device 212 could be located elsewhere, such a scanning device located on the housing 204, a scanning device held above the surface 202, and the like. In some embodiments, the packer performs a specific action for the scanning device 212 to be able to read the identifier, such as placing a barcode on the object within a field of view of a barcode reader that is part of the scanning device 212. In some embodiments, the scanning device 212 is capable of determining the identifier of the object without any specific packer action, such as in the case of one or more cameras mounted above the automated packaging station 200 that are capable of taking images of the object that are usable for image classification without any specific packer action.

In the depicted embodiment, the automated packaging station 200 includes a user interface 214. In some embodiments, the user interface 214 is configured to receive user input regarding operation of the automated packaging station 200 and/or output information about operation of the automated packaging station 200. In the depicted embodiment, the user interface 214 includes a number of buttons. In other embodiments, the user interface 214 can include any type of user input and/or output device, such as a touchscreen device, a display device, a keyboard, or any other user interface device. In the depicted embodiment, the user interface 214 is located on the surface 202. In other embodiments, the user interface 214 can be located elsewhere, as may be convenient for the packer. In some embodiments, the user interface may be included on a computing device (e.g., a tablet computing device) that is mounted to or located near the automated packaging station 200.

After the object is scanned by the scanning device 212 and inserted through the aperture 206, the object can be packaged inside a package in the space encompassed by the housing 204. In the depicted embodiment, the automated packaging station 200 has formed a package 216 around an object. In some embodiments, the package 216 may be made from an opaque air cellular material. The air cellular material of the package 216 may provide cushioning to protect the object during shipment. The opacity of the package 216 may make the package 216 suitable for shipping because a viewer of the package 216 cannot easily see inside of the package 216. Also in the depicted embodiment, the automated packaging station 200 has placed a shipping label 218 on the package 216.

The automated packaging station 200 is configured to carry the package 216 out of the housing 204. In the depicted embodiment, the automated packaging station 200 includes a conveying mechanism 220 in the form of a conveyor belt to carry the package 216 out of the housing 204. In the depicted embodiment, the conveying mechanism passes from the inside the housing 204 to outside the housing 204 through an opening 222 in the housing 204. The conveying mechanism 220 is configured to carry packages in a conveying direction 224. While the conveying mechanism 220 in the depicted embodiment is a conveyor belt, the conveying mechanism may be any other mechanism configured to carry the package 216 out of the housing 204, such as driven rollers, driven wheels, an escalator, and the like.

In some embodiments, the automated packaging station 200 is configured to form the package 216, capture the object in the package 216 as the object is inserted through the aperture 206, close the package with the object located therein, label the package, and carry the package out of the housing 204. Thus, the packer needs only ensure that the object is scanned by the scanning device 212 and insert the object through the aperture 206 to cause the object to be packaged in the package 216 and be ready for shipping. Under normal operation of the automated packaging station 200 (e.g., when the automated packaging station 200 is sufficiently stocked with packaging material), the packer does not need to handle any of the packaging material used to form the package 216, place the shipping label 218 on the package 216, or otherwise prepare the package 216 to be ready for shipping. In this way, the automated packaging station 200 allows the packer to form 12-25 packages per minute or more. The automated packaging station 200 also does not become disorganized with stocked packaging materials, cushioning material, void fill material, or waste from the packaging process because the packer is not handling any of those materials at the automated packaging station 200.

Figure 3A:
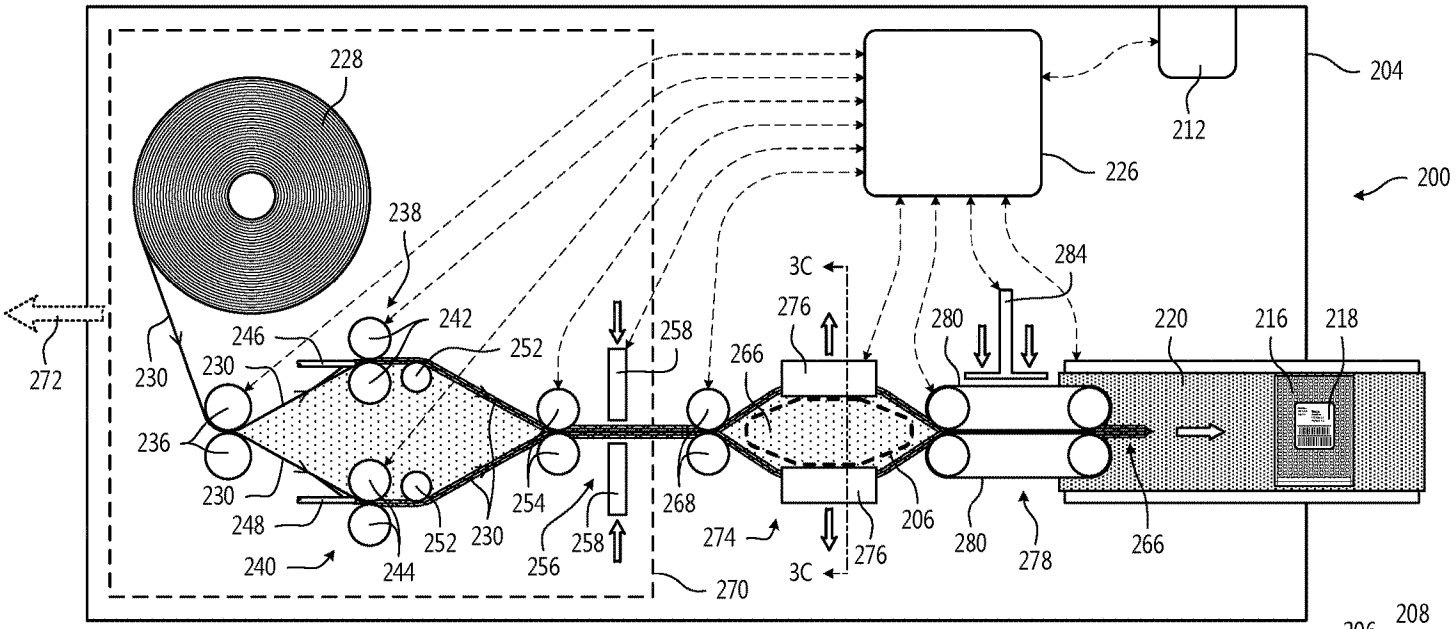
FIG. 3A depicts an embodiment of a schematic view of elements of the automated packaging station shown in FIG. 2, including a top view of a path of a web material that is used to form packages, in accordance with the embodiments described herein.

As noted above, the housing 204 may encompass elements of the automated packaging station 200 below the surface 202 that provide at least semi-automation of the packaging process. Depicted in FIG. 3A is an embodiment of a schematic view of elements of the automated packaging station 200 inside of the housing 204, including a top view of a path of a web material that is used to form packages. Depicted in FIG. 3B is a side view of an embodiment of the path of the web material shown in FIG. 3A.

The automated packaging station 200 includes a computing device 226. In some embodiments, the computing device 226 is a controller implemented in circuitry (e.g., a printed circuit board). In the depicted embodiment, the computing device 226 is shown as being located within the space encompassed by the housing 204 under the surface 202. In other embodiments, the computing device 226 can be located outside of the housing 204. In some embodiments, the computing device 226 can be located remotely from the automated packaging station 200. In the depicted embodiment, the computing device 226 in communicatively coupled to the scanning device 212 (as shown by the long-dashed double arrow). As discussed above, when the scanning device 212 reads or determines an identifier associated with an object, the scanning device 212 can communicate the identifier associated with the object to the computing device 226. As discussed in greater detail below, the computing device 226 can control elements of the automated packaging station 200 based on the identifier.

The automated packaging station 200 includes a supply 228 of web material 230 that is located below the surface 202 with the housing 204. In the depicted embodiment, the supply 228 is in the form of a roll with the web material 230 wound around a core. The supply 228 is arranged such that the axis of the roll is substantially vertical. In the depicted embodiment, the web material 230 is an air cellular material that includes a series of chambers 232. The web material is folded longitudinally such that the two longitudinal edges of the web material 230 is located at the top of the supply 228 and the longitudinal fold is located at the bottom of the supply 228. In the depicted embodiment, the web material 230 includes common channels 234 at each of the longitudinal edges of the web material 230. The chambers 232 are in fluid communication with the common channels 234 such that the chambers can be inflated by inserting a gas through the common channels 234. While on the supply, the chambers 232 are in a non-inflated state such that the web material 230 is in a "flat" condition on the supply 228 and can be wound tightly on the roll. In some embodiments, the supply 228 is located on a substantially vertical spindle that is configured to rotate freely such that the web material 230 unwinds from the supply 228 as the web material 230 is pulled from the supply 228. In other embodiments, the supply can be powered to actively unwind the web material 230 from the supply 228.

The automated packaging station 200 includes rollers 236. As can be seen in FIG. 3A, the web material 230 can be fed from the supply 228 to the rollers 236. The two longitudinal edges of the web material 230 pass through the rollers 236. In some embodiments, the rollers 236 are counterrotating driving rollers that rotate to advance web material 230 from the supply. In the depicted embodiment, the rollers 236 are communicatively coupled to the computing device 226 so that the computing device 226 can control the movements of the rollers 236 to thereby control the feeding of the web material 230 from the supply 228. In other embodiments, the rollers 236 can be passive rollers through which the longitudinal edges of the web material 230 pass, but that rotate passively as the web material 230 is moved by another element. In examples of rollers depicted herein, rollers are typically shown as contacting a portion of the web material 230, such as the portion of the web material 230 near the common channels 234. It will be understood that the rollers could extend across any portion of the web material 230, such as across the entire transverse width of the web material 230.

In the depicted embodiment, the automated packaging station 200 includes an inflation and sealing system 238 and an inflation and sealing system 240. The inflation and sealing system 238 includes rollers 242 and the inflation and sealing system 240 includes rollers 244. The rollers 242 form a nip therebetween and the rollers 244 form a nip therebetween so that one longitudinal edge of the web material 230 passes through the rollers 242 and the other longitudinal edge of the web material 230 passes through the rollers 244. As can be seen in FIG. 3A, the two longitudinal edges of the web material 230 diverge after passing through the rollers 236 as one longitudinal edge travels toward the rollers 242 and the other longitudinal edge travels toward the rollers 244. The divergence of the longitudinal edges of the web material 230 tends to reduce the severity of the longitudinal fold in the web material so that web material 230 at the rollers 242 and 244 does not have a sharply-creased fold, but the cross section of the web material 230 at the rollers 242 and 244 tends to have the shape of a "V" or a "U" (e.g., see FIG. 3C).

The inflation and sealing system 238 includes an inflation nozzle 246 and the inflation and sealing system 240 includes an inflation nozzle 248. The inflation nozzles 246 and 248 are configured to direct gas (e.g., air) into the web material 230. More specifically, ends of the inflation nozzles 246 and 248—the ends out of which gas is directed—are located in the common channels 234 on the longitudinal sides of the web material 230. Gas is directed out of the inflation nozzles 246 and 248, through the common channels 234, and into the chambers 232 to cause inflation of the chambers 232. In some embodiments, the chambers 232 provide fluid communication between the common channels 234 so that the gas from the inflation nozzles 246 and 248 inflates the chambers 232 from both ends of the chambers 232. In this case, the web material 230 having a cross sectional "U" or "V" shape increases the likelihood of gas passing through the longitudinal fold in the web material 230. In some embodiments, the chambers 232 have shapes that define multiple cells. In the depicted embodiment, each of the chambers 232 has substantially circular cells that are interconnected by channels that are narrower than the widest point of the cells. Once the chambers 232 are inflated, the cells form three-dimensional shapes (sometimes referred to as "bubbles") along the inflated chambers 232. In the depicted embodiment, a pair of adjacent chambers 232 are offset so that the cells of one of the chambers 232 are aligned with the interconnecting cells of a subsequent one of the chambers 232.

In the depicted embodiment, the rollers 242 and the rollers 244 are configured to form longitudinal seals 250 in the web material 230 after inflation of the chambers 232. In the depicted embodiment, the rollers 242 form one of the longitudinal seals 250 to individually close ends of the chambers on one side of the web material 230 and the rollers 244 form another of the longitudinal seals 250 to individually close ends of the chambers on the other side of the web material 230. In some embodiments, one of the rollers 242 includes a circumferential heating element that contacts the web material 230 as it passes between the rollers 242 to form a heat seal in the web material 230. Similarly, in some embodiments, one of the rollers 244 includes a circumferential heating element that contacts the web material 230 as it passes between the rollers 244 to form a heat seal in the web material 230. In other embodiments, the inflation and sealing systems 238 and 240 may include drag sealers or any other form of sealer to form the longitudinal seals 250. In other embodiments, the ends of the chambers 232 may include one-way seals that allow gas to enter the chambers 232 and holds the gas within the chambers 232 without the need of additional heat seals.

The common channels 234 may have any form of common channel on the longitudinal edges of the web material 230. In some embodiments, when the web material 230 is on the supply 228, each of the common channels 234 has two sheets that are connected to each other (either because they are formed from a single piece of material or because they are otherwise connected to each other). In these embodiments, the common channels 234 are "closed" channels. When the common channels 234 are closed, the common channels 234 need to be cut open to allow two sheets of the common channels 234 to pass on either side of an inflation nozzle. For example, one of the common channels 234 is cut open before it passes by the inflation nozzle 246 so that its two sheets can pass on either side of the inflation nozzle 246 and another of the common channels 234 is cut open before it passes by the inflation nozzle 248 so that its two sheets can pass on either side of the inflation nozzle 248. In some embodiments, when the web material 230 is on the supply 228, each of the common channels 234 has two sheets that are not connected to each other. In these embodiments, the common channels 234 are "open" channels. When the common channels 234 are open, the two sheets of the common channels 234 can pass on either side of an inflation nozzle without being cut. For example, one of the common channels 234 passes by the inflation nozzle 246 with its two sheets on either side of the inflation nozzle 246 and another of the common channels 234 passes by the inflation nozzle 248 with its two sheets on either side of the inflation nozzle 248.

In the depicted embodiment, the computing device 226 is communicatively coupled to each of the inflation and sealing systems 238 and 240. In some embodiments, the computing device 226 is configured to control aspects of the inflation and sealing systems 238 and 240. For example, the computing device 226 can control one or more of whether gas is directed out of the inflation nozzles 246 and 248, the flow rate of gas out of the inflation nozzles 246 and 248, the rate at which the rollers 242 and 244 rotate, the temperature of the heating elements on the rollers 242 and 244 that form the longitudinal seals 250, and the like.

In a variation of the embodiment shown in FIGS. 3A and 3B, a web material may have chambers that open into a common channel on one longitudinal side of the web material but are closed on the other longitudinal side of the web material. For example, the longitudinal side of the web material 230 that passes through the inflation and sealing system 240 may have the common channel 234 that is in fluid communication with the chambers 232 just as is shown in FIG. 3B. However, near the other longitudinal edge of the web material 230 (i.e., the longitudinal edge that is not visible in FIG. 3B), the chambers 232 are closed and there is no common channel. In this case, the automated packaging station 200 may include the rollers 242 to maintain the path of the web material 230, but not include the inflation nozzle 246 because the chambers 232 do not inflate from that side of the web material 230.

In the depicted embodiment, after the two longitudinal edges of the web material 230 pass through the inflation and sealing systems 238 and 240, the path of the web material 230 is defined by rollers 252 and rollers 254. In some embodiments, the rollers 252 are idler rollers that passively rotate as the web material 230 moves. In the depicted embodiment, the computing device 226 is not communicatively coupled to the rollers 252 because the rollers 252 are passive and cannot be controlled. The rollers 254 are positioned such that the two longitudinal edges of the web material 230 are brought back together after the chambers 232 are inflated. Both longitudinal edges of the web material 230 pass between the rollers 254. In some embodiments, the rollers 254 are driving rollers that cause the web material 230 to move. In the depicted embodiment, the computing device 226 is communicatively coupled to the rollers 254 in order to control rollers 254, such as controlling the speed at which the rollers 254 rotate, the distance between rollers 254, and the like.

Downstream of the rollers 254 is a seal and cutting system 256. In the depicted embodiment, the seal and cutting system 256 includes jaws 258 that extend vertically from above the longitudinal edges of the web material 230 (i.e., above the highest point of the web material 230 when viewed in FIG. 3B) to below the longitudinal fold of the web material 230 (i.e., below the lowest point of the web material 230 when viewed in FIG. 3B). At the instance depicted in FIG. 3A, the jaws 258 are withdrawn from the web material 230 to permit the web material 230 to be fed. The jaws 258 can periodically be brought together against the web material 230 (as indicated by the arrows outside of the jaws 258). In some embodiments, the jaws 258 include heating elements configured to form a trailing transverse seal 260, a transverse line of weakness 262, and a leading transverse seal 264 when the jaws 258 are brought together against the web material 230. The trailing transverse seal 260 closes a side of one of the pouch 266 (i.e., the left side of one of the pouches 266 when viewed in FIG. 3B), the transverse line of weakness 262 forms a break between the one of the pouches 266 and a subsequent one of the pouches 266, and the leading transverse seal 264 closes a side of the subsequent one of the pouch 266 (i.e., the right side of the subsequent one of the pouches 266 when viewed in FIG. 3B). In some embodiments, the heating elements may be located on one or both of the jaws 258, and each of the heating elements may be located on a face of one of the jaws 258 that faces the other one of the jaws 258. In this way, the heating elements on one or both of the faces of the jaws 258 come into contact with the web material 230 when the jaws 258 are brought together against the web material 230.

In the depicted embodiment, the automated packaging station 200 includes rollers 268 that are downstream of the seal and cutting system 256. The rollers 268 are positioned such that the two longitudinal edges of the web material 230 pass between the rollers 268. In some embodiments, the rollers 268 are driving rollers that cause the web material 230 to move. In the depicted embodiment, the computing device 226 is communicatively coupled to the rollers 268 in order to control rollers 268, such as controlling the speed at which the rollers 268 rotate, the distance between rollers 268, and the like. In some embodiments, the computing device 226 is configured to control the rollers 254 and the rollers 268 in order to provide a level of tension in the web material 230 between the rollers 254 and the rollers 268 while the jaws 258 are brought together. This control may increase the likelihood of the jaws 258 successfully forming the trailing transverse seal 260, the transverse line of weakness 262, and the leading transverse seal 264.

The line of weakness 262 formed by the seal and cutting system 256 may take a number of forms. In some embodiments, the line of weakness 262 is a complete cut through the web material that separates one of the pouches 266 from the web material 230 when the line of weakness 262 is formed. In some embodiments, the line of weakness 262 is a deformation of the web material 230 between two of the pouches 266, such as a perforation, a score, a partial cut, and the like. In the embodiments where the line of weakness 262 is not a complete cut through the web material 230, the line of weakness 262 may be formed in a way such that the line of weakness 262 is broken within the automated packaging station 200 at a point downstream of the seal and cutting system 256.

In some embodiments, the frequency at which the seal and cutting system 256 forms the trailing transverse seal 260, the transverse line of weakness 262, and the leading transverse seal 264 are formed can be controlled to control widths of the pouches 266. In the depicted embodiment, the seal and cutting system 256 is communicatively coupled to the computing device 226. The computing device 226 can control the frequency at which the jaws 258 are brought together to form the trailing transverse seal 260, the transverse line of weakness 262, and the leading transverse seal 264. In some embodiments, when the computing device 226 receives an identifier associated with the object from the scanning device 212, the computing device 226 controls to the seal and cutting system 256 to form one of the pouches 266 to a width based on the identifier of the object.

In some embodiments, the supply 228, the rollers 236, the inflation and sealing systems 238 and 240, the rollers 252, the rollers 254, and the seal and cutting system 256 are positioned on a movable structure 270. In the depicted embodiment, the movable structure 270 is configured to be moved out of the housing 204 in a direction 272. In some embodiments, the direction 272 is substantially opposite of a direction that the conveying mechanism 220 carries packages out of the housing 204. In some embodiments, the movable structure 270 is a tray that moved by sliding along guides. In some embodiments, the housing 204 includes a door or other closure that is closed during normal operation of the automated packaging station 200, but can be opened to move the movable structure 270 out of the housing 204. When the movable structure 270 is out of the housing 204, a packer or other user can replace the supply 228 of web material, such as after the entire web material 230 has been used. The packer or other user can also feed the new web material through the components on the movable structure 270 (e.g., the rollers 236, the inflation and sealing systems 238 and 240, the rollers 252, the rollers 254, and the seal and cutting system 256) much more easily than if those components were inside the housing 204. After the supply 228 has been replaced and the new web material properly fed, the movable structure 270 can be moved back inside the housing 204 and the housing 204 can be closed to resume normal operation of the automated packaging station 200.

The automated packaging station 200 includes a pouch biasing system 274 that is configured to bias open the pouches 266 for the insertion of objects. In the depicted embodiment, the pouch biasing system 274 includes biasing brackets 276 each of which are configured to bias one of the longitudinal edges of the web material 230 away from the other longitudinal edge so that the top of the pouch is open. In the depicted embodiment, the biasing brackets 276 are substantially aligned with the aperture 206 (depicted in dashed lines in FIG. 3A) in the surface 202 so that the biasing brackets 276 hold the pouch 266 open below the aperture 206. This positioning is also depicted in the cross-sectional view of the web material 230, the biasing brackets 276, and the aperture 206 shown in FIG. 3C. When the biasing brackets 276 bias the pouch 266 open, the packer can insert an object through the aperture 206 in the direction 208 so that the object falls into the pouch 266. In the depicted embodiment, the biasing brackets 276 are mechanical plows that are inserted into the top of the pouch 266 and are pulled away from each other to bias the pouch 206 open. In other embodiments, the biasing brackets 276 may be any other form of biasing bracket, such as one or more vacuum cups on each side of the pouch 266, where the vacuum cups are capable of temporarily coupling to the outside of the top of the pouch 266 to bias the pouch 206 open. In the depicted embodiment, the aperture 206 in the surface 202 is an aperture that is cut out from the surface 202 so that the object is inserted through the surface 202. In other embodiments, the aperture 206 in the surface 202 can be an aperture that is coupled to the surface 202. For example, the aperture 206 in the surface 202 could be the end of a conveying mechanism (e.g., a chute, tube, conduit, slide, or other conveying mechanism) that coupled to the surface 202 where the conveying mechanism is arranged so that a packer can place an object from the surface into the aperture (e.g., the end of the conveying mechanism) and the conveying mechanism carries the object to a point below the surface 202 where the object can then fall into the pouch 226.

In the depicted embodiment, the pouch biasing system 274 is communicatively coupled to the computing device 226 so that the computing device 226 can control the pouch biasing system 274. In some embodiments, the biasing brackets 276 are biased toward each other (in a "closed" position) unless the biasing brackets 276 are activated to move to the position shown in FIGS. 3A and 3C (in an "open" position). In some cases, the biasing brackets 276 are arranges such that, when the biasing brackets 276 are in a closed position, the biasing brackets 276 substantially cover the aperture 206. This position of the biasing brackets 276 deters the likelihood of an object being inserted through the aperture 206 when the pouch 266 is not ready to receive the object and also serves as a visual indicator to the packer that the packer needs to wait before inserting an object. Other visual indicators may optionally be used near the opening, such as red backlighting near the aperture 206 that is illuminated when the packer should not insert an object and green backlighting near the aperture 206 that is illuminated when the packer can insert an object. In some embodiments, the biasing force that biases the biasing brackets 276 closed in below a predetermined level such that the biasing brackets 276 are not capable of causing serious injury to a packer (e.g., a packer's finger or of a packer's hand) when the biasing brackets 276 are closed.

In some embodiments, the automated packaging station 200 may include a support located under the pouch 266 to deter the pouch 266 from dislodging from its proper location. In one example, the automated packaging station 200 may include a static surface that is located below the aperture 206 and located at a height where the bottom of the pouch 266 is expected to be when an object falls into the pouch 266. In this way, the surface can provide support to offset the force of the object as it falls into the bottom of the pouch 266. In another example, the automated packaging station 200 may include a movable surface that is retracted when the web material 230 and/or the pouch 266 are being advanced through the automated packaging station 200, and then extended to a location that is below the pouch 266 when the biasing brackets 276 are opened to permit the object to fall into the pouch 266. The movable surface may be extended to a height where the bottom of the pouch 266 is expected to be when an object falls into the pouch 266 so that the movable surface provides support to offset the force of the object as it falls into the bottom of the pouch 266.

The automated packaging station 200 can perform a number of checks to ensure that the proper object is inserted into the pouch 266 when the biasing brackets 276 are in the open position. In some embodiments, the automated packaging station 200 can include a sensor below the aperture 206, such as a proximity sensor, that is capable of detecting a number of items that were inserted through the opening into the pouch 266. In cases where the object to be packaged is a single object, the computing device 226 may cause the biasing brackets 276 to close upon detection of a single item being inserted through the aperture 206. In cases where the object to be packaged includes several distinct items, the computing device 226 may cause the biasing brackets 276 to remain open upon detection of a first item being inserted through the aperture 206 and then remain open until detection of the appropriate number of items being inserted through the aperture 206. In some embodiments the automated packaging station 200 can include a sensor that detect a weight of the pouch 266. When the proper object is inserted to the pouch 266, the computing device 226 may cause the biasing brackets 276 to close upon detection of an appropriate weight of the object in the pouch. When an improper object is inserted to the pouch 266, the computing device 226 may cause the automated packaging station 200 to issue a warning message that the incorrect object was placed in the pouch 266 or otherwise flag the pouch 266 as being defective.

The automated packaging station 200 also includes a closing system 278 configured to close the pouches 266 to form packages 216. The closing system 278 is located downstream of the pouch biasing system 274 so that the pouches 266 pass through the closing system 278 after objects have already been inserted into the pouches 266. In the depicted embodiment, the closing system 278 includes belts 280 that counterrotate as the pouches 266 through the belts 280. In some embodiments, the belts 280 are positioned such that the two longitudinal edges of the web material 230 that form the pouches 266 pass between the belts 280. In some embodiments, the belts 280 are driving belts that cause the pouches 266 to move. In the depicted embodiment, the computing device 226 is communicatively coupled to the closing system 278 in order to control closing system 278, such as controlling the speed at which the belts 280 rotate, the distance between belts 280, and the like.

In some embodiments, the closing system 278 is configured to close the pouches 266 by forming a longitudinal seal 282 near the longitudinal edges of the web material 230. In the depicted embodiment, the longitudinal seal 282 is formed in the pouches 266 in the common channels 234 of the web material. It will be understood that the longitudinal seal 282 could be formed elsewhere in the pouches 266, such as across the inflated chamber 232, in order to close the pouches 266. Once one of the pouches is closed by the closing system 278 to form the package 216, the object is enclosed in the package 216 by the longitudinal fold on the bottom, the leading and trailing transverse seals 260 and 264 on the left and right sides, and the longitudinal seal 282 on the top.

The material used to form the web material 230 may be selected such that the package 216 is suitable for use as a mailer itself. In one example, the material used to form the web material 230 may be selected so that, after inflation of the chambers 232, the web material 230 remains sufficiently opaque to serve as a mailer. In another example, the material used to form the web material 230 may be selected so that, after inflation of the chambers 232 and formation into the package 216, package 216 has sufficient rigidity to be used in mailer sorting and handing facilities. In another example, the material used to form the web material 230 may be selected so that the package 216 is capable of withstanding typical wear that occurs during shipping and handling without deflating a significant number of the inflated chambers 232. In another example, the material used to form the web material 230 may be selected so that, after inflation of the chambers 232, the web material is capable of having a shipping label attached thereto. Other considerations may be taken into account when selecting the material used to form the web material 230.

The automated packaging station 200 also includes a labeling system 284 configured to label the exterior of the package 216. In some embodiments, the labeling system 284 is configured to print on an adhesive label and then apply the adhesive label to a side of one of the pouches 266. In some embodiments, the labeling system 284 is configured to print a label directly on the side of one of the pouches 266. In the depicted embodiment, the labeling system 284 is communicatively coupled to the computing device 226. In some embodiments, the computing device 226 is configured to obtain shipping information for the object in response to receiving the identifier associated with the object from the scanning device 212. For example, the computing device 226 may identify the shipping information from a local database that stores shipping information from objects. In another example, the computing device 226 may identify the shipping information by communicating with a remote computing device (e.g., a computing device located outside of the automated packaging station 200) and receiving the shipping information from the remote computing device. The labeling system 284 can include the shipping information on the label the is printed on and/or applied to the package 216.

Under normal operations, the automated packaging station 200 is capable of withdrawing web material 230, inflating and sealing the web material 230, forming the web material 230 into pouches 266, biasing open the pouch to permit an object to be dropped into the pouch 266, closing the pouch 266 to form a package around the object, and labeling the package 216 for shipping. The labor performed by the packer is to ensure that the object is scanned by the scanning device 212 and then insert the object through the aperture 206 so the object falls into the open pouch 266. It will be appreciated that the steps performed by the packer could also be automated so that the automated packaging station or some other automated system ensured that the object was scanned and then inserted through the aperture 206 into the open pouch 266. As noted above, with the relatively minimal labor required of a packer to package an object using the automated packaging station 200, the pack rate of a single packer can increase dramatically from about 1-3 packages per minute without the automated packaging station 200 to 12-25 packages per minute using the automated packaging station 200. Additionally, the amount of training required to scan an object and drop it in an aperture is so low that a new packer can become an "expert" at using the automated packaging station 200 to package objects in a very short time.

Figure 3C:
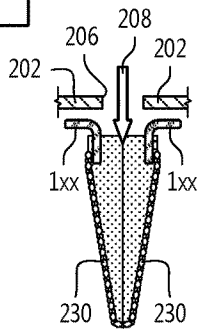
FIG. 3C depicts a cross section of a web material at rollers, where the cross section of the web material tends to have the shape of a "V" or a "U"
Figure 3B:
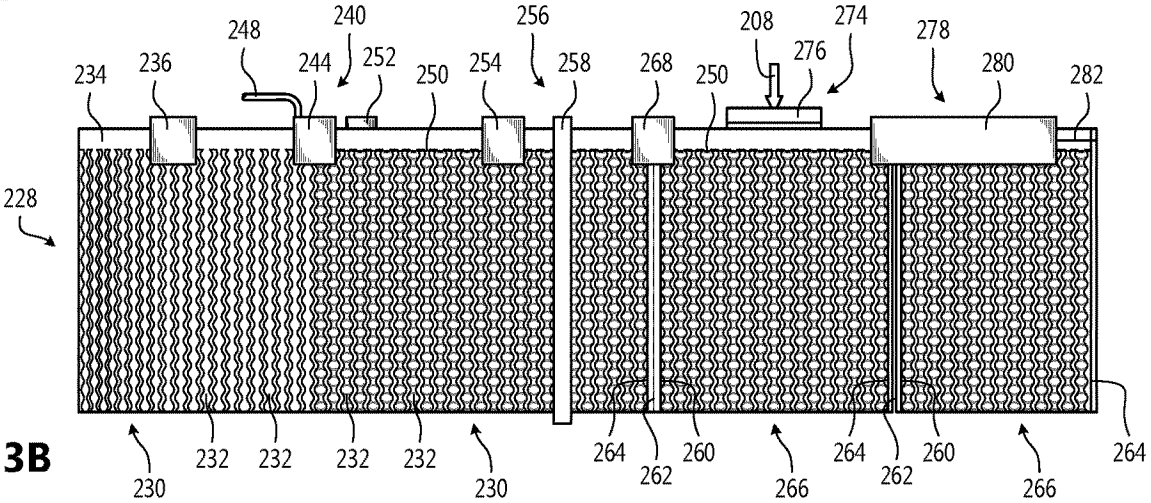
FIG. 3B depicts a side view of an embodiment of the path of the web material shown in FIG. 3A, in accordance with the embodiments described herein.

There are a number of advantages to the arrangement shown in FIGS. 3A to 3C where the web material 230 is arranged to be moved substantially horizontally through the housing 204 and the pouches 266 are arranged to receive objects in a substantially vertical direction. Previous attempts at mailer automation include a string of preformed pouches that are fed vertically with the open side of the pouches arranged vertically. In order for a packer to insert an object into those pouches, the packer either needs to reach his or her hand into the pouch or attempt to toss the object substantially horizontally into the open pouch. When a packer reaches his or her hand into the pouch, the packer often has a risk of being injured while his or her hand is in the pouch or at least a fear of being injured. Attempting to toss an object substantially horizontally into an open pouch requires skill and dexterity that an average packer may not possess without practice and it is not humanly possible to successfully toss objects in this manner each and every time that an object is to be packaged. Additionally, these strings of pouches with side openings may be able to hold a single item until the pouch is closed; however, when multiple distinct items are placed in the pouch at least some of the items tend to fall out of the open side before the pouch is closed.

The open-top orientation of the pouches 266 in the automated packaging station 200 have a number of advantages that are not realized by the open-side pouches described in the preceding paragraph. In one example, the force of gravity aids in the filling of objects into the pouches 266 because the pouches 266 are arranged so that objects drop substantially vertically into the pouches 266. This means that the packer does not need to reach into the pouches 266 or toss the objects in any way. In another example, the open-top orientation of the pouches 266 easily accepts and holds multiple distinct items until the pouches are closed. This allows a shipping facility to place multiple items in the same package rather than sending multiple packages each holding a single item. In another example, the widths of the pouches 266 in the automated packaging station 200 can be easily varied based on the object. This provides a reduced dim weight shipping cost of the packages 216, which often is used to determine the cost of shipping light-weight mailers.

Figure 4:
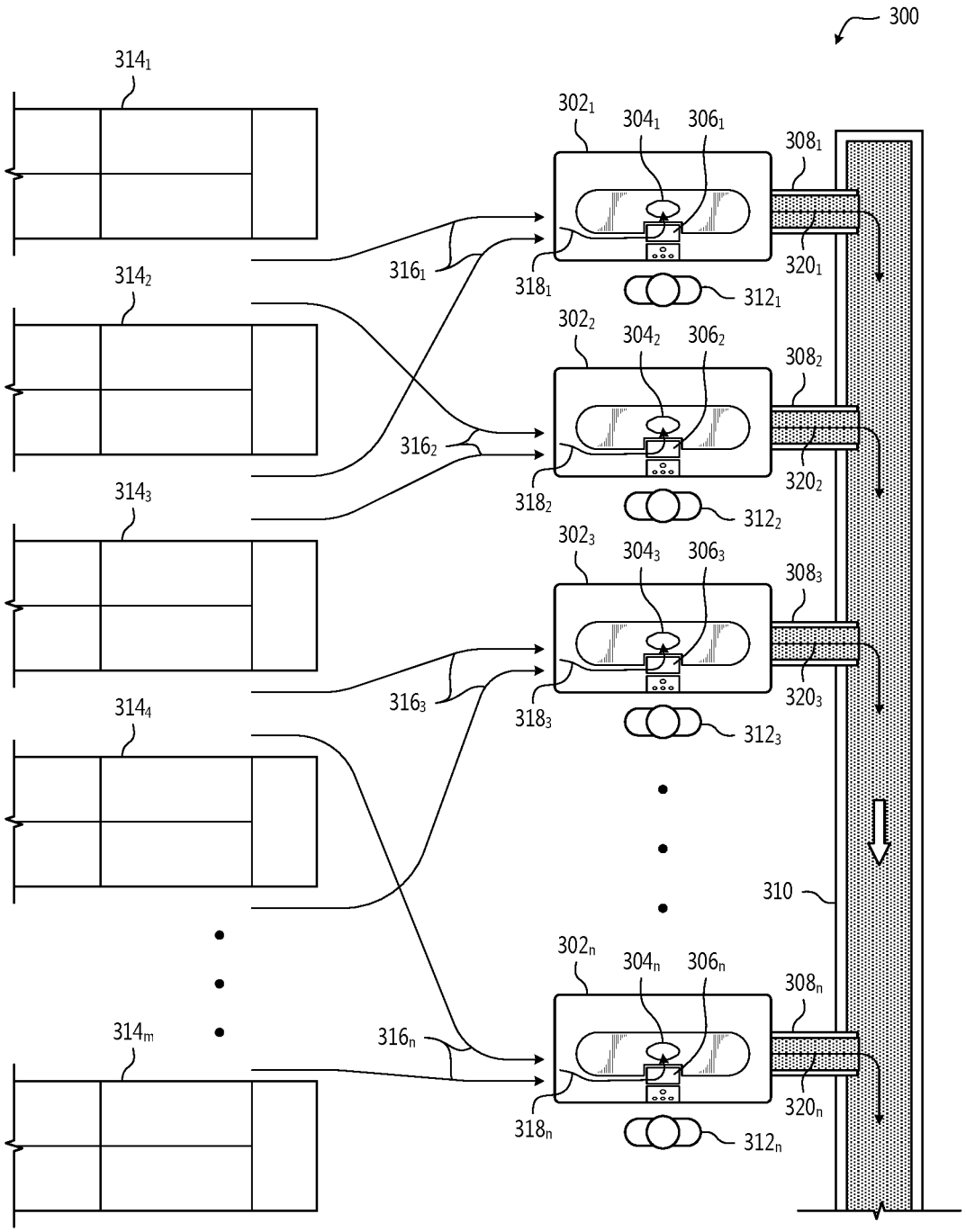
FIG. 4 depicts an embodiment of a packaging facility that includes multiple automated packaging stations, in accordance with the embodiments described herein.

The automated packaging station 200 may be used as a stand-alone packaging station where a single station forms and prepares packages for shipping. However, in large packaging facilities, an individual automated packaging station may not provide sufficient throughput for the shipping needs of the packaging facility. Depicted in FIG. 4 is an embodiment of a packaging facility 300 that includes multiple automated packaging stations.

The packaging facility 300 includes automated packaging stations $\mathbf{302}_1$, $\mathbf{302}_2$, $\mathbf{302}_3$, . . . , $\mathbf{302}_n$ (collectively, automated packaging stations 302). In some embodiments, each of the automated packaging stations 302 is the same as or similar to the automated packaging station 200 described above. It will be apparent that the automated packaging stations 302 can include the four automated packaging stations depicted in FIG. 4 or any other number of automated packaging stations, including more than or less than the four depicted.

The automated packaging stations $\mathbf{302}_1$, $\mathbf{302}_2$, $\mathbf{302}_3$, . . . , $\mathbf{302}_n$ include apertures $\mathbf{304}_1$, $\mathbf{304}_2$, $\mathbf{304}_3$, . . . , $\mathbf{304}_n$ (collectively, apertures 304), respectively, in their surfaces. The apertures 304 are configured to have objects inserted therethrough so that the objects fall into pouches formed by the automated packaging stations 302. The automated packaging stations $\mathbf{302}_1$, $\mathbf{302}_2$, $\mathbf{302}_3$, . . . , $\mathbf{302}_n$ also include scanning devices $\mathbf{306}_1$, $\mathbf{306}_2$, $\mathbf{306}_3$, . . . , $\mathbf{306}_n$ (collectively, scanning devices 306), respectively. The scanning devices 306 are configured to read or determine an identifier associated with objects before the objects are inserted through the apertures 304.

After the objects are inserted into the pouches formed by the automated packaging stations 302, the automated packaging stations 302 are configured to form the pouches into shipping-ready packages. The automated packaging stations $\mathbf{302}_1$, $\mathbf{302}_2$, $\mathbf{302}_3$, . . . , $\mathbf{302}_n$ include conveying mechanisms $308_1$, $308_2$, $308_3$, . . . , $308_n$ (collectively, conveying mechanisms 308), respectively, that are configured to carry the packages out of the automated packaging stations 302. In the depicted embodiment, each of the conveying mechanisms 308 is configured to convey the packages from their respective automated packaging stations 302 to a common conveying mechanism 310. In some embodiments, the common conveying mechanism 310 is configured to convey the packages received from the conveying mechanisms 308 to a location where the packages will be further processed for shipping (e.g., loaded onto a shipping truck).

In the depicted embodiments, the automated packaging stations $302_1$, $302_2$, $302_3$, . . . , $302_n$ are operated by packers $312_1$, $312_2$, $312_3$, . . . , $312_n$ (collectively, packers 312), respectively. Operations in the packaging facility 300 are described herein in terms of the packers 312 operating the automated packaging stations 302. However, as described above, it is possible for an automated system to perform operations that are described herein as if they are performed by a packer. Thus, any of the descriptions herein of operations performed by the packers 312 would be understood to include the performance of the same operations by automated systems.

The packaging facility 300 also includes inventory shelves $314_1$, $314_2$, $314_3$, . . . , $314_m$ (collectively, inventory shelves 314). In some embodiments, the inventory shelves 314 hold objects that can be shipped from the packaging facility. The inventory shelves 314 may be fixed to a particular location within the packaging facility 300 or may be movable, such as by an autonomous vehicle. It will be apparent that the inventory shelves 314 can include the five sets of inventory shelves depicted in FIG. 4 or any other number of inventory shelves, including more than or less than the five sets depicted.

When the packers package objects, the objects can be brought from the inventory shelves 314 to the automated packaging stations 302 along delivery routes $316_1$, $316_2$, $316_3$, . . . , $316_n$ (collectively, delivery routes 316). The objects can be brought along delivery routes 316 by the packers 312 themselves, by other workers in the packaging facility 300 (typically referred to as "pickers"), or by autonomous vehicles. Preferably, when objects are delivered by the packers 312, pickers, or by autonomous vehicles, objects that will be packaged in multiple packages will be delivered so that the packers 312 can sequentially package multiple packages without requiring a new delivery from the inventory shelves 314.

After the objects are delivered, the packers $312_1$, $312_2$, $312_3$, . . . , $312_n$ can cause movements $318_1$, $318_2$, $318_3$, . . . , $318_n$ (collectively, movements 318), respectively, of the objects to so that the objects are scanned by the scanning devices 306 and the inserted through the apertures 304. One benefit to the use of the automated packaging stations 302 for packaging is that the objects do not need to remain in a particular order when then are delivered and/or scanned. For example, if a group of objects have been delivered to the automated packaging stations $302_1$, the packer $312_1$ can select any one of the objects and scan it using the scanning device $306_1$. The automated packaging station $302_1$ can identify, based on an identifier scanned by the scanning device $306_1$, the shipping information for that particular item and prepare a package accordingly (e.g., printing the proper shipping label). The packer $312_1$ does not need to select specific object in a specific order to ensure that the objects are properly packaged.

After each object is packaged by one of the automated packaging stations 302, the packages formed with the object inside is carried along one of the conveying paths $320_1$, $320_2$, $320_3$, . . . , $320_n$ (collectively, conveying paths 320). In the depicted embodiment, the conveying paths 320 pass along one of the conveying mechanisms 308 and the common conveying mechanism 310.

The operations described in the packaging facility 300 can be performed in parallel so that each of the automated packaging stations 302 is being used in parallel with the others. These operations can provide a very high pack rate within the packaging facility 300. For example, if each of the four automated packaging stations 302 depicted in FIG. 4 is operated at a rate of 15 packages packed per minute, then a completed and shipping-ready package is placed on the common conveying mechanism 310 on average once every second. Such a packing rate could not be accomplished by four packers without the aid and reliability of the automated packaging stations described herein.

Figure 5:
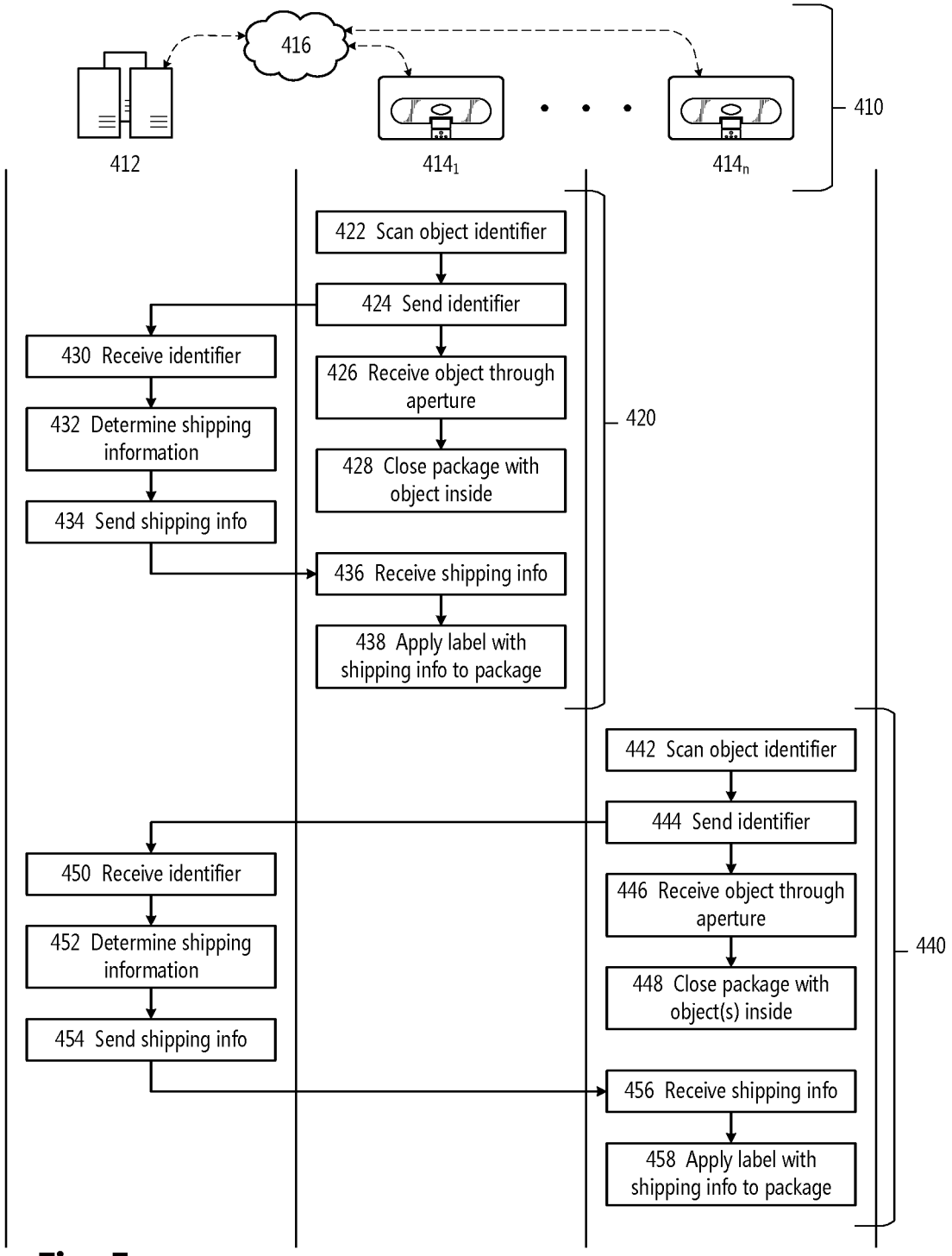
FIG. 5 depicts an embodiment of a method of facilitating the use of multiple automated packaging stations, in accordance with the embodiments described herein.

Depicted in FIG. 5 is an embodiment of a method 400 of facilitating the use of multiple automated packaging stations. The method 400 is capable of being performed by a system 410 that includes a computing system 412 and automated packaging stations $414_1$, . . . , $414_n$ (collectively, automated packaging stations 414). The computing system 412 can include one or more computing devices, such as servers, that are capable of storing and processing information. In some embodiments, the computing system 412 is located in a data center or other computing device housing facility. The computing system 412 is communicatively coupled to a network 416. The network 416 may include any number of wired and/or wireless networks, such as the internet, local area networks, cellular telephone networks, WiFi networks, and the like. The network 416 is communicatively coupled to each of the automated packaging stations 414. Each of the automated packaging stations 414 may include one or more computing devices, such as a server, a desktop computer, a laptop computer, a tablet computing device, a mobile telephone, a controller implemented in circuitry, and the like. Each of the computing system 412 and the automated packaging stations 414 is capable of communicating information to and from each of the others of the computing system 412 and the automated packaging stations 414 via the network 416. It will be noted that the automated packaging stations 414 may be located remotely from the computing system 412, but some or all of the automated packaging stations 414 could be located locally with the computing system 412.

The depicted method 400 includes a first part 420. At block 422, the automated packaging station $414_1$ scans an identifier associated with an object. In some embodiments, the identifier associated with the object includes a unique identifier of the object, an identifier of the type of the object, an identifier of an order which includes the object, any other identifier associated with the object, or any combination thereof. In some embodiments, the automated packaging station $414_1$ scans the identifier associated with the object using a scanning device. At block 424, the automated packaging station $414_1$ sends the identifier to the computing system 412 via the network 416. The automated packaging station $414_1$ may be configured to automatically send the identifier to the computing system 412 in response to scanning the identifier.

At block 426, the automated packaging station $414_1$ receives the object through an aperture. In some embodiments, the object is received into a pouch that was formed by the automated packaging station $414_1$ and is biased open by the automated packaging station $414_1$ so that the pouch catches the object as it falls through the aperture. In some embodiments, the pouch is formed from a protective material, such as an air cellular material, a foam-padded liner (e.g., polyethylene film, Kraft paper, etc.). As noted above, the object can include a single distinct item or multiple distinct items. In embodiments where the object includes multiple distinct items, the automated packaging station 414$_1$ may hold the pouch under the aperture until all of the distinct items have been received through the aperture into the pouch. At block 428, the automated packaging station 414$_1$ closes pouch to form a package. In some embodiments, the package is a suitable for shipping the object to a recipient.

At block 430, the computing system 412 receives the identifier associated with the object. In the depicted embodiment, the identifier was sent to the computing system 412, at block 424, from the automated packaging station 414$_1$ via the network 416. At block 432, the computing system 412 determines shipping information for the object. In some embodiments, the computing system 412 determines the shipping information locally, such as in a lookup table or other database in the computing system 412. In some embodiments, the computing system 412 determines the shipping information remotely, such as by communicating with a remote computing system to obtain the shipping information. In some embodiments, the computing system 412 determines the shipping information both locally and remotely, such as by looking up a shipping recipient and method of shipping in a local database within the computing system 412 and communicating with a remote computing device to obtain carrier information (e.g., a tracking number) for the shipment of the object. At block 434, the computing system 412 sends the shipping information to the automated packaging station 414$_1$ via the network 416.

At block 436, the automated packaging station 414$_1$ receives the shipping information. In the depicted embodiment, the shipping information was sent to the automated packaging station 414$_1$, at block 434, from the computing system 412 via the network 416. At block 438, the automated packaging station 414$_1$ applies a label with the shipping information to the package. In some embodiments, the label is applied to the package by printing the shipping information on an adhesive label and then applying the adhesive label to the package. In some embodiments, the label is applied to the package by printing the shipping information directly onto the package. In the depicted embodiment, the label is applied to the package at block 438 after the package is closed at block 428. It will be apparent that, in other embodiments, the label can be applied to the pouch before the pouch is closed to form the package.

As can be seen in FIG. 5, the operations performed by the automated packaging station 414$_1$ at blocks 426 and 428 can be performed in parallel with the operations of the computing system 412 at blocks 430, 432, and 434. In this way, the shipping information may be sent to the automated packaging station 414$_1$ so that the automated packaging station 414$_1$ is able to apply the label to the package as soon as possible after the automated packaging station 414$_1$ sends the identifier to the computing system 412 at block 424.

The depicted method 400 includes a second part 440. At block 442, the automated packaging station 414$_n$ scans an identifier associated with an object. In some embodiments, the identifier associated with the object includes a unique identifier of the object, an identifier of the type of the object, an identifier of an order which includes the object, any other identifier associated with the object, or any combination thereof. In some embodiments, the automated packaging station 414$_n$ scans the identifier associated with the object using a scanning device. At block 444, the automated packaging station 414$_n$ sends the identifier to the computing system 412 via the network 416. The automated packaging station 414$_n$ may be configured to automatically send the identifier to the computing system 412 in response to scanning the identifier.

At block 446, the automated packaging station 414$_n$ receives the object through an aperture. In some embodiments, the object is received into a pouch that was formed by the automated packaging station 414$_n$ and is biased open by the automated packaging station 414$_n$ so that the pouch catches the object as it falls through the aperture. In some embodiments, the pouch is formed from a protective material, such as an air cellular material, a foam-padded liner (e.g., polyethylene film, Kraft paper, etc.). As noted above, the object can include a single distinct item or multiple distinct items. In embodiments where the object includes multiple distinct items, the automated packaging station 414$_n$ may hold the pouch under the aperture until all of the distinct items have been received through the aperture into the pouch. At block 448, the automated packaging station 414$_n$ closes the pouch to form a package. In some embodiments, the package is suitable for shipping the object to a recipient.

At block 450, the computing system 412 receives the identifier associated with the object. In the depicted embodiment, the identifier was sent to the computing system 412, at block 444, from the automated packaging station 414$_n$ via the network 416. At block 452, the computing system 412 determines shipping information for the object. In some embodiments, the computing system 412 determines the shipping information locally, such as in a lookup table or other database in the computing system 412. In some embodiments, the computing system 412 determines the shipping information remotely, such as by communicating with a remote computing system to obtain the shipping information. In some embodiments, the computing system 412 determines the shipping information both locally and remotely, such as by looking up a shipping recipient and method of shipping in a local database within the computing system 412 and communicating with a remote computing device to obtain carrier information (e.g., a tracking number) for the shipment of the object. At block 454, the computing system 412 sends the shipping information to the automated packaging station 414$_n$ via the network 416.

At block 456, the automated packaging station 414$_n$ receives the shipping information. In the depicted embodiment, the shipping information was sent to the automated packaging station 414$_n$, at block 454, from the computing system 412 via the network 416. At block 458, the automated packaging station 414$_n$ applies a label with the shipping information to the package. In some embodiments, the label is applied to the package by printing the shipping information on an adhesive label and then applying the adhesive label to the package. In some embodiments, the label is applied to the package by printing the shipping information directly onto the package. In the depicted embodiment, the label is applied to the package at block 458 after the package is closed at block 448. It will be apparent that, in other embodiments, the label can be applied to the pouch before the pouch is closed to form the package.

As can be seen in FIG. 5, the operations performed by the automated packaging station 414$_n$ at blocks 446 and 448 can be performed in parallel with the operations of the computing system 412 at blocks 450, 452, and 454. In this way, the shipping information may be sent to the automated packaging station 414$_n$ so that the automated packaging station $414_n$ is able to apply the label to the package as soon as possible after the automated packaging station $414_n$ sends the identifier to the computing system 412 at block 444.

In the embodiment depicted in FIG. 5, the first part 420 and the second part 440 of the method 400 are performed in series. It will be apparent that the first part 420 and the second part 440 of the method 400 are performed at least partially or fully in parallel with each other. In this way, each of the automated packaging stations 414 can initiate the packaging of an object at any moment and the automated packaging stations 414 can carry out the packaging by communicating with the computing system 412 in at least partially or fully in parallel with each other.

Figure 6:
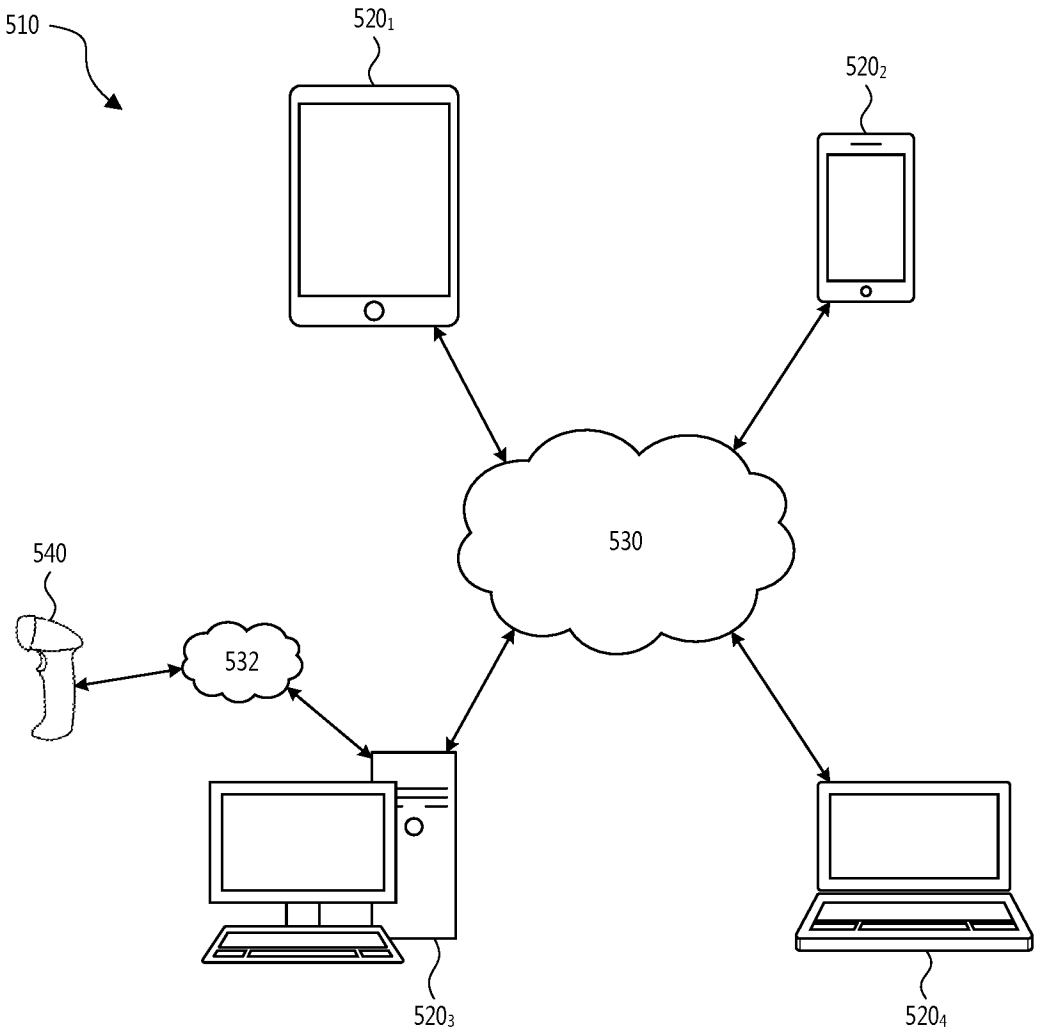
FIG. 6 depicts an example embodiment of a system that may be used to implement some or all of the embodiments described herein.

FIG. 6 depicts an example embodiment of a system 510 that may be used to implement some or all of the embodiments described herein. In the depicted embodiment, the system 510 includes computing devices $520_1$, $520_2$, $520_3$, and $520_4$ (collectively computing devices 520). In the depicted embodiment, the computing device $520_1$ is a tablet, the computing device $520_2$ is a mobile phone, the computing device $520_3$ is a desktop computer, and the computing device $520_4$ is a laptop computer. In other embodiments, the computing devices 520 include one or more of a desktop computer, a mobile phone, a tablet, a phablet, a notebook computer, a laptop computer, a distributed system, a gaming console (e.g., Xbox, Play Station, Wii), a watch, a pair of glasses, a key fob, a radio frequency identification (RFID) tag, an ear piece, a scanner, a television, a dongle, a camera, a wristband, a wearable item, a kiosk, an input terminal, a server, a server network, a blade, a gateway, a switch, a processing device, a processing entity, a set-top box, a relay, a router, a network access point, a base station, any other device configured to perform the functions, operations, and/or processes described herein, or any combination thereof.

The computing devices 520 are communicatively coupled to each other via one or more networks 530 and 532. Each of the networks 530 and 532 may include one or more wired or wireless networks (e.g., a 3G network, the Internet, an internal network, a proprietary network, a secured network). The computing devices 520 are capable of communicating with each other and/or any other computing devices via one or more wired or wireless networks. While the particular system 510 in FIG. 6 depicts that the computing devices 520 communicatively coupled via the network 530 include four computing devices, any number of computing devices may be communicatively coupled via the network 530.

In the depicted embodiment, the computing device $520_3$ is communicatively coupled with a peripheral device 540 via the network 532. In the depicted embodiment, the peripheral device 540 is a scanner, such as a barcode scanner, an optical scanner, a computer vision device, and the like. In some embodiments, the network 532 is a wired network (e.g., a direct wired connection between the peripheral device 540 and the computing device $520_3$), a wireless network (e.g., a Bluetooth connection or a WiFi connection), or a combination of wired and wireless networks (e.g., a Bluetooth connection between the peripheral device 540 and a cradle of the peripheral device 540 and a wired connection between the peripheral device 540 and the computing device $520_3$). In some embodiments, the peripheral device 540 is itself a computing device (sometimes called a "smart" device). In other embodiments, the peripheral device 540 is not a computing device (sometimes called a "dumb" device).

Figure 7:
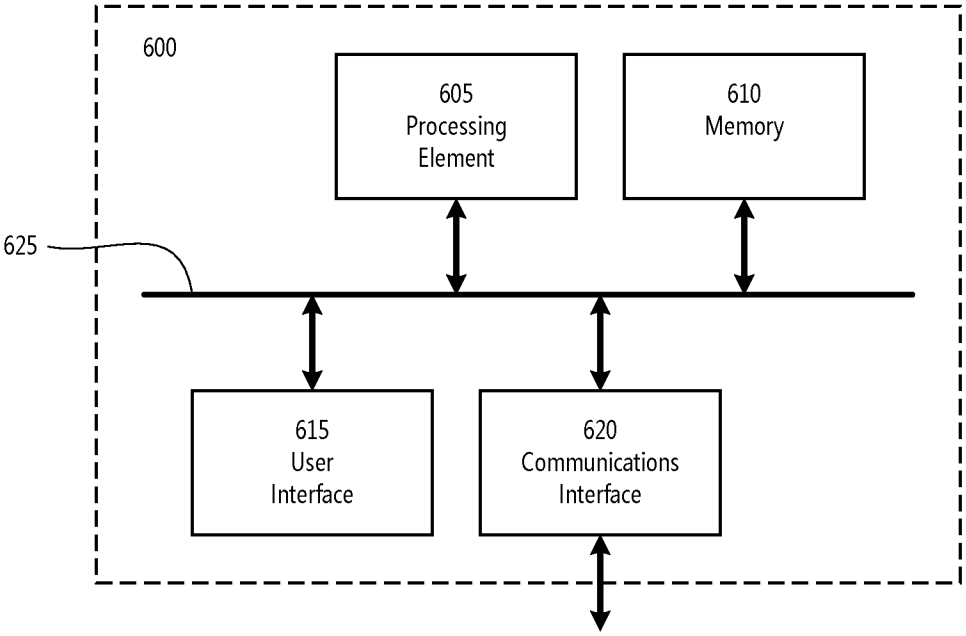
FIG. 7 depicts a block diagram of an embodiment of a computing device, in accordance with the embodiments described herein.

Depicted in FIG. 7 is a block diagram of an embodiment of a computing device 600. Any of the computing devices 520 and/or any other computing device described herein may include some or all of the components and features of the computing device 600. In some embodiments, the computing device 600 is one or more of a desktop computer, a mobile phone, a tablet, a phablet, a notebook computer, a laptop computer, a distributed system, a gaming console (e.g., an Xbox, a Play Station, a Wii), a watch, a pair of glasses, a key fob, a radio frequency identification (RFID) tag, an ear piece, a scanner, a television, a dongle, a camera, a wristband, a wearable item, a kiosk, an input terminal, a server, a server network, a blade, a gateway, a switch, a processing device, a processing entity, a set-top box, a relay, a router, a network access point, a base station, any other device configured to perform the functions, operations, and/or processes described herein, or any combination thereof. Such functions, operations, and/or processes may include, for example, transmitting, receiving, operating on, processing, displaying, storing, determining, creating/generating, monitoring, evaluating, comparing, and/or similar terms used herein. In one embodiment, these functions, operations, and/or processes can be performed on data, content, information, and/or similar terms used herein.

In the depicted embodiment, the computing device 600 includes a processing element 605, memory 610, a user interface 615, and a communications interface 620. The processing element 605, memory 610, a user interface 615, and a communications interface 620 are capable of communicating via a communication bus 625 by reading data from and/or writing data to the communication bus 625. The computing device 600 may include other components that are capable of communicating via the communication bus 625. In other embodiments, the computing device does not include the communication bus 625 and the components of the computing device 600 are capable of communicating with each other in some other way.

The processing element 605 (also referred to as one or more processors, processing circuitry, and/or similar terms used herein) is capable of performing operations on some external data source. For example, the processing element may perform operations on data in the memory 610, data receives via the user interface 615, and/or data received via the communications interface 620. As will be understood, the processing element 605 may be embodied in a number of different ways. In some embodiments, the processing element 605 includes one or more complex programmable logic devices (CPLDs), microprocessors, multi-core processors, co processing entities, application-specific instruction-set processors (ASIPs), microcontrollers, controllers, integrated circuits, application specific integrated circuits (ASICs), field programmable gate arrays (FPGAs), programmable logic arrays (PLAs), hardware accelerators, any other circuitry, or any combination thereof. The term circuitry may refer to an entirely hardware embodiment or a combination of hardware and computer program products. In some embodiments, the processing element 605 is configured for a particular use or configured to execute instructions stored in volatile or nonvolatile media or otherwise accessible to the processing element 605. As such, whether configured by hardware or computer program products, or by a combination thereof, the processing element 605 may be capable of performing steps or operations when configured accordingly.

The memory 610 in the computing device 600 is configured to store data, computer-executable instructions, and/or any other information. In some embodiments, the memory 610 includes volatile memory (also referred to as volatile storage, volatile media, volatile memory circuitry, and the like), non-volatile memory (also referred to as non-volatile storage, non-volatile media, non-volatile memory circuitry, and the like), or some combination thereof.

In some embodiments, volatile memory includes one or more of random access memory (RAM), dynamic random access memory (DRAM), static random access memory (SRAM), fast page mode dynamic random access memory (FPM DRAM), extended data-out dynamic random access memory (EDO DRAM), synchronous dynamic random access memory (SDRAM), double data rate synchronous dynamic random access memory (DDR SDRAM), double data rate type two synchronous dynamic random access memory (DDR2 SDRAM), double data rate type three synchronous dynamic random access memory (DDR3 SDRAM), Rambus dynamic random access memory (RDRAM), Twin Transistor RAM (TTRAM), Thyristor RAM (T-RAM), Zero-capacitor (Z-RAM), Rambus in-line memory module (RIMM), dual in-line memory module (DIMM), single in-line memory module (SIMM), video random access memory (VRAM), cache memory (including various levels), flash memory, any other memory that requires power to store information, or any combination thereof.

In some embodiments, non-volatile memory includes one or more of hard disks, floppy disks, flexible disks, solid-state storage (SSS) (e.g., a solid state drive (SSD)), solid state cards (SSC), solid state modules (SSM), enterprise flash drives, magnetic tapes, any other non-transitory magnetic media, compact disc read only memory (CD ROM), compact disc-rewritable (CD-RW), digital versatile disc (DVD), Blu-ray disc (BD), any other non-transitory optical media, read-only memory (ROM), programmable read-only memory (PROM), erasable programmable read-only memory (EPROM), electrically erasable programmable read-only memory (EEPROM), flash memory (e.g., Serial, NAND, NOR, and/or the like), multimedia memory cards (MMC), secure digital (SD) memory cards, Memory Sticks, conductive-bridging random access memory (CBRAM), phase-change random access memory (PRAM), ferroelectric random-access memory (FeRAM), non-volatile random access memory (NVRAM), magneto-resistive random access memory (MRAM), resistive random-access memory (RRAM), Silicon Oxide-Nitride-Oxide-Silicon memory (SONOS), floating junction gate random access memory (FJG RAM), Millipede memory, racetrack memory, any other memory that does not require power to store information, or any combination thereof.

In some embodiments, memory 610 is capable of storing one or more of databases, database instances, database management systems, data, applications, programs, program modules, scripts, source code, object code, byte code, compiled code, interpreted code, machine code, executable instructions, or any other information. The term database, database instance, database management system, and/or similar terms used herein may refer to a collection of records or data that is stored in a computer-readable storage medium using one or more database models, such as a hierarchical database model, network model, relational model, entity relationship model, object model, document model, semantic model, graph model, or any other model.

The user interface 615 of the computing device 600 is in communication with one or more input or output devices that are capable of receiving inputs into and/or outputting any outputs from the computing device 600. Embodiments of input devices include a keyboard, a mouse, a touchscreen display, a touch sensitive pad, a motion input device, movement input device, an audio input, a pointing device input, a joystick input, a keypad input, peripheral device 540, foot switch, and the like. Embodiments of output devices include an audio output device, a video output, a display device, a motion output device, a movement output device, a printing device, and the like. In some embodiments, the user interface 615 includes hardware that is configured to communicate with one or more input devices and/or output devices via wired and/or wireless connections.

The communications interface 620 is capable of communicating with various computing devices and/or networks. In some embodiments, the communications interface 620 is capable of communicating data, content, and/or any other information, that can be transmitted, received, operated on, processed, displayed, stored, and the like. Communication via the communications interface 620 may be executed using a wired data transmission protocol, such as fiber distributed data interface (FDDI), digital subscriber line (DSL), Ethernet, asynchronous transfer mode (ATM), frame relay, data over cable service interface specification (DOCSIS), or any other wired transmission protocol. Similarly, communication via the communications interface 620 may be executed using a wireless data transmission protocol, such as general packet radio service (GPRS), Universal Mobile Telecommunications System (UMTS), Code Division Multiple Access 2000 (CDMA2000), CDMA2000 1× (1×RTT), Wideband Code Division Multiple Access (WCDMA), Global System for Mobile Communications (GSM), Enhanced Data rates for GSM Evolution (EDGE), Time Division-Synchronous Code Division Multiple Access (TD-SCDMA), Long Term Evolution (LTE), Evolved Universal Terrestrial Radio Access Network (E-UTRAN), Evolution-Data Optimized (EVDO), High Speed Packet Access (HSPA), High-Speed Downlink Packet Access (HSDPA), IEEE 802.11 (WiFi), WiFi Direct, 802.16 (WiMAX), ultra wideband (UWB), infrared (IR) protocols, near field communication (NFC) protocols, Wibree, Bluetooth protocols, wireless universal serial bus (USB) protocols, or any other wireless protocol.

As will be appreciated by those skilled in the art, one or more components of the computing device 600 may be located remotely from other components of the computing device 600 components, such as in a distributed system. Furthermore, one or more of the components may be combined and additional components performing functions described herein may be included in the computing device 600. Thus, the computing device 600 can be adapted to accommodate a variety of needs and circumstances. The depicted and described architectures and descriptions are provided for exemplary purposes only and are not limiting to the various embodiments described herein.

Embodiments described herein may be implemented in various ways, including as computer program products that comprise articles of manufacture. A computer program product may include a non-transitory computer-readable storage medium storing applications, programs, program modules, scripts, source code, program code, object code, byte code, compiled code, interpreted code, machine code, executable instructions, and/or the like (also referred to herein as executable instructions, instructions for execution, computer program products, program code, and/or similar terms used herein interchangeably). Such non-transitory computer-readable storage media include all computer-readable media (including volatile and non-volatile media).

As should be appreciated, various embodiments of the embodiments described herein may also be implemented as methods, apparatus, systems, computing devices, and the like. As such, embodiments described herein may take the form of an apparatus, system, computing device, and the like executing instructions stored on a computer readable storage medium to perform certain steps or operations. Thus, embodiments described herein may be implemented entirely in hardware, entirely in a computer program product, or in an embodiment that comprises combination of computer program products and hardware performing certain steps or operations.

Embodiments described herein may be made with reference to block diagrams and flowchart illustrations. Thus, it should be understood that blocks of a block diagram and flowchart illustrations may be implemented in the form of a computer program product, in an entirely hardware embodiment, in a combination of hardware and computer program products, or in apparatus, systems, computing devices, and the like carrying out instructions, operations, or steps. Such instructions, operations, or steps may be stored on a computer readable storage medium for execution buy a processing element in a computing device. For example, retrieval, loading, and execution of code may be performed sequentially such that one instruction is retrieved, loaded, and executed at a time. In some exemplary embodiments, retrieval, loading, and/or execution may be performed in parallel such that multiple instructions are retrieved, loaded, and/or executed together. Thus, such embodiments can produce specifically configured machines performing the steps or operations specified in the block diagrams and flowchart illustrations. Accordingly, the block diagrams and flowchart illustrations support various combinations of embodiments for performing the specified instructions, operations, or steps.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. An automated packaging station comprising:

a supply of web material, wherein the automated packaging station is configured to form the web material into a pouch;

a surface;

an aperture configured such that an object can be inserted therethrough, wherein the automated packaging station is configured to bias open the pouch beneath the surface such that the object inserted through the aperture falls into the pouch; and a closing system configured to close the pouch to form a package around the object in response to the object being inserted through the aperture;

wherein the object is capable of being shipped to a recipient in the package;

wherein the supply of the web material is located below the surface;

wherein the web material has a series of chambers;

wherein the automated packaging station further includes an inflation and sealing system configured to inflate the chambers and to individually seal the chambers as part of forming the web material into the pouch;

wherein the automated packaging station further comprises:

a seal and cutting system configured to form a trailing transverse seal, a leading transverse seal, and transverse line of weakness in the web material after inflation of the chambers, wherein the seal and cutting system is located below the surface;

a movable structure located under the surface; and a housing located under the surface;

wherein the supply, the inflation and sealing system, and the seal and cutting system are positioned on the movable structure;

wherein the supply, the inflation and sealing system, and the seal and cutting system are located within the housing; and wherein the supply, the inflation and sealing system, and the seal and cutting system are capable of being moved out of the housing by moving the movable structure.

2. The automated packaging station of claim 1, further comprising:

a pouch biasing system configured to bias open the pouch;

wherein the pouch biasing system is configured to bias open the pouch beneath the surface such that the object inserted through the aperture falls into the pouch.

3. The automated packaging station of claim 2, wherein the pouch biasing system comprises:

biasing brackets configured to be moved from a closed position to an open position;

wherein, when the biasing brackets are in the open position, the biasing brackets bias edges of an opening of the pouch away from each other.

4. The automated packaging station of claim 3, wherein:

the biasing brackets are biased toward the closed position; and when the biasing brackets are in the closed position, the biasing brackets substantially cover the aperture.

5. The automated packaging station of claim 3, further comprising:

a computing device communicatively coupled to the pouch biasing system wherein the computing device is configured to control the pouch biasing system to:

cause the biasing brackets to move to the open position in response to the automated packaging station being ready to have the object inserted through the aperture, and cause the biasing brackets to move to the closed position in response to the object being inserted through the aperture.

6. The automated packaging station of claim 1, the automated packaging station is configured to bias open the pouch beneath the surface such that an object inserted through the aperture by falling substantially vertically into the pouch.

7. The automated packaging station of claim 1, further comprising:

a conveying mechanism configured to carry the package out from the automated packaging station in response to the closing system closing the pouch to form the package.

8. The automated packaging station of claim 1, wherein a portion of the surface includes a view panel that is transparent or semi-transparent, and wherein the aperture is located in the view panel.

9. An automated packaging station comprising:

a supply of web material, wherein the automated packaging station is configured to form the web material into a pouch;

a surface;

an aperture configured such that an object can be inserted therethrough, wherein the automated packaging station is configured to bias open the pouch beneath the surface such that the object inserted through the aperture falls into the pouch;

a closing system configured to close the pouch to form a package around the object in response to the object being inserted through the aperture, wherein the object is capable of being shipped to a recipient in the package;

a labelling system configured to apply a label to the package, wherein the label includes shipping information for shipping the package;

a scanning device configured to scan or determine an identifier associated with the object before the object is inserted through the aperture; and a computing device communicatively coupled to each of the scanning device and the labeling system, wherein the computing device is configured to:

receive the identifier from the scanning device, determine the shipping information based on the identifier, and provide the shipping information to the labeling system before the labeling system applied the label to the package.

10. The automated packaging station of claim 9, wherein applying the label to the package includes at least one of:

printing the shipping information on an adhesive label and adhering the adhesive label to the package; or printing the shipping information directly on the package.

11. A system for packaging objects, comprising:

a common conveying mechanism; and a plurality of automated packaging stations, wherein each of the plurality of automated packaging stations includes a surface and an aperture, and wherein each of the plurality of automated packaging stations is configured to:

form a web material into a pouch, bias open the pouch beneath the surface such that an object inserted through the aperture falls into the pouch, and close the pouch to form a package around the object in response to the object being inserted through the aperture;

wherein packages formed by respective ones of the plurality of automated packaging stations are configured to be conveyed from the respective ones of the plurality of automated packaging stations to the common conveying mechanism;

wherein the system further comprises a computing system communicatively coupled to each of the plurality of automated packaging stations;

wherein each of the plurality of automated packaging stations includes a scanning device capable of scanning or determining an identifier associated with an object to be packaged;

wherein the computing system is configured to receive identifiers associated with objects from the plurality of automated packaging stations and to provide shipping information to the plurality of automated packaging stations based on the identifiers received from the plurality of automated packaging stations;

wherein each of the plurality of automated packaging stations is configured to apply labels to packages based on the shipping information received from the computing system.

* * * * *